US008951705B2

(12) United States Patent
Nakayama et al.

(10) Patent No.: US 8,951,705 B2
(45) **Date of Patent: *Feb. 10, 2015**

(54) DEVELOPMENT AGENT AND IMAGE FORMING APPARATUS EMPLOYING SAME

(71) Applicants: Shinya Nakayama, Shizuoka (JP); Atsushi Yamamoto, Shizuoka (JP); Yukiko Nakajima, Kanagawa (JP); Masahide Yamada, Shizuoka (JP); Hideyuki Santo, Kanagawa (JP); Suzuka Amemori, Shizuoka (JP)

(72) Inventors: Shinya Nakayama, Shizuoka (JP); Atsushi Yamamoto, Shizuoka (JP); Yukiko Nakajima, Kanagawa (JP); Masahide Yamada, Shizuoka (JP); Hideyuki Santo, Kanagawa (JP); Suzuka Amemori, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 32 days.

This patent is subject to a terminal disclaimer.

(21) Appl. No.: 13/783,561

(22) Filed: Mar. 4, 2013

(65) Prior Publication Data

US 2013/0244153 A1 Sep. 19, 2013

(30) Foreign Application Priority Data

Mar. 13, 2012 (JP) ..... 2012-056340
Jan. 8, 2013 (JP) ..... 2013-001357

(51) Int. Cl.
*G03G 9/08* (2006.01)
*G03G 9/087* (2006.01)
*G03G 9/097* (2006.01)

(52) U.S. Cl.
CPC ..... *G03G 9/08* (2013.01); *G03G 9/0821* (2013.01); *G03G 9/08751* (2013.01); *G03G 9/08755* (2013.01); *G03G 9/08764* (2013.01); *G03G 9/08788* (2013.01); *G03G 9/08795* (2013.01); *G03G 9/08797* (2013.01); *G03G 9/09708* (2013.01); *G03G 9/09716* (2013.01)
USPC ..... 430/108.22; 430/109.5; 399/252

(58) Field of Classification Search
CPC ..... G03G 9/08764; G03G 9/09716
USPC ..... 430/108.22, 109.5; 399/252
See application file for complete search history.

(56) References Cited

U.S. PATENT DOCUMENTS

2012/0282000 A1 11/2012 Nakayama et al.

FOREIGN PATENT DOCUMENTS

| | | |
|---|---|---|
| JP | 63-038955 | 2/1988 |
| JP | 2001-305796 | 11/2001 |
| JP | 2001-330997 | 11/2001 |
| JP | 2007-199655 | 8/2007 |
| JP | 2009-003135 | 1/2009 |
| JP | 2009-258477 | 11/2009 |
| JP | 2010-077419 | 4/2010 |
| JP | 2012-042939 | 3/2012 |

*Primary Examiner* — Mark A Chapman
(74) *Attorney, Agent, or Firm* — Oblon, Spivak, McClelland, Maier & Neustadt, L.L.P.

(57) ABSTRACT

A development agent containing toner that contains a binder resin having a crystalline resin that has a urethane and/or urea bond in its main chain, a coloring agent, and an organically modified inorganic laminate compound in which organic ions are at least partially substituted for ions present between layers of the organically modified inorganic laminate compound, and toner carrier that contains a core material whose surface is coated with a coating layer having a condensed compound of a melamine resin and/or a guanamine resin and an acrylic resin having a hydroxyl group.

16 Claims, 2 Drawing Sheets

DEVELOPMENT AGENT AND IMAGE FORMING APPARATUS EMPLOYING SAME

CROSS-REFERENCE TO RELATED APPLICATIONS

This patent application is based on and claims priority pursuant to 35 U.S.C. §119 to Japanese Patent Application Nos. 2012-056340 and 2013-001357, filed on Mar. 13, 2012 and Jan. 8, 2013, respectively, in the Japan Patent Office, the entire disclosures of which are hereby incorporated by reference herein.

BACKGROUND

1. Field

The present invention relates to a development agent and an image forming apparatus employing the development agent.

2. Background Art

Latent images formed electrically or magnetically are typically rendered visible by an electrophotographic image forming apparatus using a development agent containing toner and toner carrier.

A latent electrostatic image is formed on an image bearing member and thereafter developed with toner charged by friction with the carrier to obtain a toner image.

The toner image is then transferred to a transfer medium, typically paper, and thereafter fixed thereon.

In the process in which the toner image is fixed on the transfer medium, a thermal fixing system such as a heating-roller fixing system and a heating-belt fixing system is generally used for greater energy efficiency.

There continues to be market demand for energy-efficient products.

One way to meet such demand is by employing toner having excellent low-temperature fixability and high-temperature stability.

JP-2010-77419-A describes resin particles containing crystalline resin.

The resin particulates are prepared using an aqueous medium.

The resin particulates have a melting heat maximum peak temperature (Ta) of from 40° C. to 100° C. and a ratio of the softening point to Ta (softening point/Ta) of from 0.8 to 1.55.

Also, the resin particles satisfy the following conditions 1: $G'(Ta+20)=1\times10^2$ to $5\times10^5$ (Pa) and the condition 2: $G''(Ta+20)=1\times10^2$ to $5\times10^5$ (Pa), where G' represents storage elastic modulus and G" represents loss elastic modulus.

JP-2007-199655-A describes toner containing organically modified inorganic laminate minerals in which organic ions are at least partially substituted for ions present between layers of the organically-modified inorganic laminate compound.

However, toner that contains crystalline resin and organically modified inorganic laminate minerals in which organic ions are at least partially substituted for ions present between layers of the organically modified inorganic laminate compound causes a problem in that the inorganic laminate minerals detached from the surface of the toner due to the stress generated by stirring within the development device contaminate the surface of toner carrier, so that the size of the charge on the toner carrier decreases.

SUMMARY OF THE INVENTION

The present invention provides an improved development agent containing toner that contains a binder resin having crystalline resin that has a urethane and/or urea bond in its main chain, a coloring agent, and an organically modified inorganic laminate compound in which organic ions are at least partially substituted for ions present between layers of the organically modified inorganic laminate compound, and toner carrier that contains a core material whose surface is coated with a coating layer having a condensed compound of a melamine resin and/or a guanamine resin and an acrylic resin having a hydroxyl group.

BRIEF DESCRIPTION OF THE DRAWINGS

Various other objects, features and attendant advantages of the present invention will be more fully appreciated as the same become better understood from the detailed description when considered in connection with the accompanying drawings, in which like reference characters designate like corresponding parts throughout and wherein.

DETAILED DESCRIPTION OF THE INVENTION

Figure 1A:
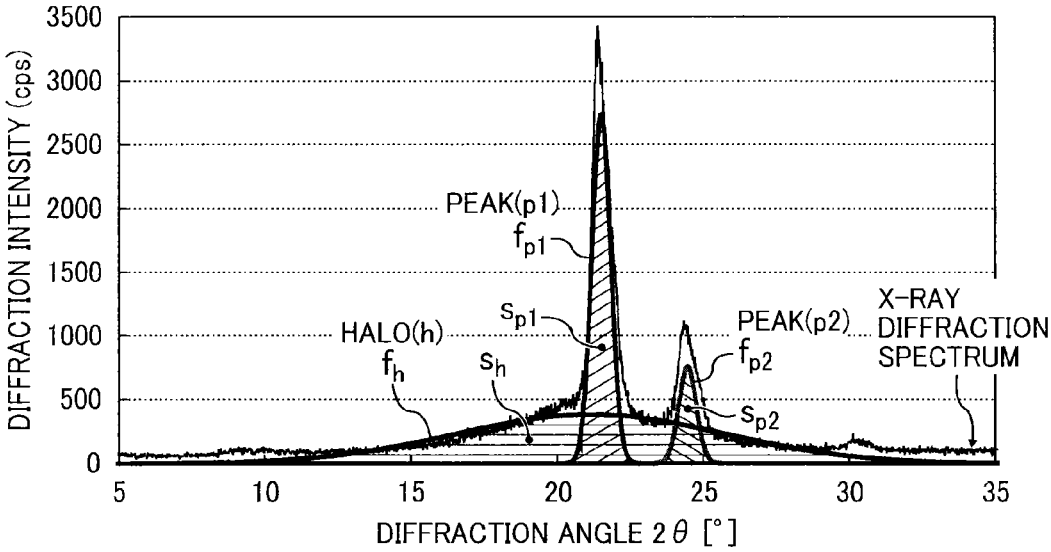
FIGS. 1A and 1B are graphs illustrating a method of calculating the crystallinity of toner.

Next, embodiments of the present disclosure are described with reference to the accompanying drawings.

The development agent contains toner and toner carrier (hereinafter simply referred to as carrier).

The toner contains a binder resin, a coloring agent, and an organically modified laminate inorganic compound and the binder resin contains a crystalline resin having a urethane bond and/or urea bond in its main chain.

The surface of the carrier is covered with a coating layer.

The coating layer contains a condensed compound of a melamine resin and/or a guanamine resin and an acrylic resin having a hydroxyl group.

The mass ratio of the toner to the carrier ranges from 0.01 to 0.10 and preferably from 0.04 to 0.08.

The content of the crystalline resin in the binder resin is preferably 50% weight or more, more preferably 65% weight or more, furthermore preferably 80% weight or more, and particularly furthermore preferably 95% weight or more.

When the content of the crystalline resin in the binder resin contained in the toner is too small, the low-temperature fixability and the high-temperature stability tend to deteriorate.

The crystalline resin has a ratio of the softening temperature to the maximum endothermic peak temperature for the second temperature rising of from 0.80 to 1.60 and softens abruptly by heat.

The maximum endothermic peak temperature for the second temperature rising can be measured by a differential scanning calorimeter (DSC).

The softening temperature can be measured by a flow tester.

There is no specific limit to the crystalline resin that has a urethane and/or urea bond in its main chain.

Specific examples thereof include, but are not limited to, polyurethane, polyurea, urethane-modified polyester, urea-modified polyester, urethane-modified polyamide, urea-modified polyamide, urethane-modified polyether, urea-modified polyether, urea-modified polyurethane, and urethane-modified polyurea.

These can be used in combination.

Among these, a polyurethane that has a composition unit deriving from polyester diol is preferable.

It is more preferable to use a combination of a polyurethane that has a composition unit deriving from polyester diol and a urea-modified polyurethane.

Polyurethane can be synthesized by polyaddition of polyol and polyisocyanate.

Among these, a polyurethane synthesized by reacting a diol and a diisocyanate is preferable.

As the polyol, a single use of a diol is suitable and a combination use of a diol and a tri- or higher alcohol.

There is no specific limit to the diol.

Specific examples thereof include, but are not limited to, aliphatic diols such as straight chain type aliphatic dios, branch type aliphatic diols; alkylene ether glycol having 4 to 36 carbon atoms; alicyclic diols having 4 to 36 carbon atoms; adducts of alicyclic diols with 1 to 30 mols of alkylene oxides such as ethylene oxide, propylene oxide, and butylene oxide; adducts of bisphenols with 2 to 30 mols of alkylene oxide such as ethylene oxide, propylene oxide, and butylene oxide; polylactone diol; polybutadiene diol; diols having a carboxyl group; diols having a sulfonic acid group or a sulfamic acid group; and diols having other functional groups such as salts of these.

These can be used alone or in combination.

Among these, aliphatic diols having 2 to 36 carbon atoms in the main chain are preferable and straight chain type aliphatic diols having 2 to 36 carbon atoms are more preferable.

The content of the straight chain type aliphatic diol is preferably 80% by mol or more and more preferably 90% by mol or more of the entire diol. When the content of the straight chain type aliphatic diol in the entire diol is too small, the low-temperature fixability and the high-temperature stability tend to deteriorate.

Specific examples of the straight chain type diols having 2 to 36 carbon atoms include, but are not limited to, ethylene glycol, 1,3-propane diol, 1,4-butane diol, 1,5-pentane diol, 1,6-hexane diol, 1,7 heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol, and 1,20-eicosane diol. Among these, ethylene glycol, 1,3-propane diol, 1,4-butane diol, 1,6-hexane diol, 1,9-nonane diol, and 1,10-decane diol are preferable.

Specific examples of the branch chain type aliphatic diols having 2 to 36 carbon atoms in the main chain include, but are not limited to, 1,2-propane glycol, butane diol, hexane diol, octane diol, decane diol, dodecane diol, tetradecane diol, neopentyl glycol, and 2,2-diethyl-1,3-propane diol.

Specific examples of the alkylene ether glycol having 4 to 36 carbon atoms include, but are not limited to, diethylene glycol, triethylene glycol, dipropylene glycol, polyethylene glycol, polypropylene glycol, and polytetramethylene ether glycol.

Specific examples of the alicyclic diols having 4 to 36 carbon atoms include, but are not limited to, 1,4-cyclohexane dimethanol and hydrogenated bisphenol A.

Specific examples of the bisphenols include, but are not limited to, bisphenol A, bisphenol F, and bisphenol S.

A specific example of the polylactone diols is poly(ε-caprolactone diol).

Specific examples of the diols having a carboxylic group include, but are not limited to, diallylol alkanoic acids having 6 to 24 carbon atoms such as 2,2-dimethylol propionic acid, 2,2-dimethylol butanoic acid, 2,2-dimethylol heptanoic acid, and 2,2-dimethylol octanoic acid.

Specific examples of the diol having a sulfonic acid group or a sulfamic acid group include, but are not limited to, N,N-bis(2-hydroxyalkyl) sulfonic acid diol and adducts thereof with alkylene oxide, where the alkyl group has one to six carbon atoms, alkylene oxide includes ethylene oxide, propylene oxide, or mixtures thereof, and the number of mols of alkylene oxide is from one to six and N,N-bis(2-hydroxyalkyl) sulfonic acid diol and adducts thereof with alkylne oxide, where the alkyl group has one to six carbon atoms, alkylne oxide includes ethylene oxide, propylene oxide, or mixtures thereof, and the number of mols of alkylene oxide is from one to six.

Specific examples of the base for use in neutralizing the salts of the diol having a carboxyl group and the diol having a sulfonic acid group or a sulfamic acid group include, but are not limited to, tertiary amines (e.g. triethyl amine) having 3 to 30 carbon atoms and alkali metals (e.g. sodium salts, etc.).

Among these, it is preferable to use an alkylene glycol having 2 to 12 carbon atoms, a diol having a carboxyl group, and an adduct of a bisphenol with an alkylene oxide.

There is no specific limit to the tri- or higher alcohol components.

Specific examples thereof include, but are not limited to, alkane polyols (e.g., alkane polyools and inner or inter molecular dehydrated compounds thereof, e.g., glycerine, trimethylol ethane, trimethylol propane, pentaerythritol, sorbitol, sorbitane, and polyglycerine) and inter or inner molecule dehydrates; Sugars and derivatives thereof (e.g., sucrose and methyl glucoside) having 3 to 36 carbon atoms; adducts of trisphenols (e.g., triphenol PA) with 2 mols to 30 mols of an alkylene oxide; Adducts of novolac resins (e.g., phenolic novolac and cresol novolac) with 2 mols to 30 mols of an alkylene oxide; and acrylic polyol (e.g., copolymers of hydroxyethyl(meth)acrylate and another vinyl-based monomer).

Among these, tri- or higher aliphatic polyols and adducts of novolac resins with an alkylene oxide are preferable and adducts of novolac resins with an alkylene oxide are more preferable.

As polyisocyanates, a single use of a diisocyanate is suitable and a combination use of a diisocyanate and a tri- or higher iscoaycnate.

There is no specific limit to the diisocyanates.

Specific examples thereof include, but are not limited to, aromatic diisocyanates, aliphatic diisocyanates, alicyclic diisocyanates, and aromatic aliphatic diisocyanates.

Among these, aromatic diisocyanates having 6 to 20 carbon atoms, aliphatic diisocyanates having 2 to 18 carbon atoms, alicyclic diisocyanates having 4 to 15 carbon atoms, aromatic aliphatic diisocyanates having 8 to 15 carbon atoms, modified diisocyanates thereof (modified compounds having a urethane group, a carbodiimide group, an allophanate group, a urea group, a biuret group, a uretdione group, a uretimine group, an isocyanulate group, and an oxazoline group) are preferable, in which the number of carbon atoms excludes the number of carbon atoms in the isocyanate group.

These can be used alone or in combination.

There is no specific limit to the aromatic diisocyanates.

Specific examples thereof include, but are not limited to, 1,3- and/or 1,4-phenylene diisocyanate, 2,4- and/or 2,6-tolylene diisocyanate (TDI), crude TDI, 2,4'- and/or 4,4'-diphenyl methane diisocyanate (MDI), crude MDI, 1,5-naphtylene diisocyanate, 4,4'4"-triphenyl methane triisocyanate, and m- or p-isocyanato phenyl sulfonyl isocyanate.

Specific examples of the aliphatic isocyanates include, but are not limited to, ethylene diisocyanate, tetramethylene diisocyanate, hexamethylene diisocyanate, dodecamethylene diisocyanate, 1,6,11-undecane triisocyanate, 2,2,4-trimethyl hexamethylene diisocyanate, lysine diisocyanate, 2,6-diisocyanato methyl caproate, bis(2-isocyanato ethyl) fumarate, bis(2-isocyanato ethyl) carbonate, and 2-isocyanatoethyl-2,6-diisocyanato hexanoate.

Specific examples of the alicyclic isocyanates include, but are not limited to, isophorone diisocyanate, dicyclo hexyl methane-4,4'-diisocyanate, cyclohexylene diisocyanate, methylcyclohexylene diisocyanate, bis(2-isocyanatoethyl)-4-cyclohexene-1,2-dicarboxylate, 2,5-norbornane diisocyanate, and 2,6-norbornane diisocyanate.

Specific examples of the aromatic aliphatic diisocyanate include, but are not limited to, m-xylylene diisocyanate, p-xylylene diisocyanate, a, a, a', a'-tetramethyl xylylene diisocyanate.

Specific examples of modified diisocyanates include, but are not limited to, modified diphenyl methane diisocyanates such as urethane-modified diphenyl methane diisocyanate, carbodiimide modified diphenyl methane diisocyanate, and trihydrocarbyl phosphate modified diphenyl methane diisocyanate, modified compounds of diisocyanates such as urethane modified trilene diisocyanate such as a prepolymer containing an isocyanate group.

Among these, aromatic diisocyanates having 6 to 15 carbon atoms, aliphatic diisocyanates having 4 to 12 carbon atoms, alicyclic diisocyanates having 4 to 15 carbon atoms are preferable, in which the number of carbon atoms excludes the number of carbon atoms in isocyanate group.

Among these, trylene diisocyanate, diphenyl methane diisocyante, hexamethylene diisocyante, hydrogenated diphenyl methane diisocyante, and isophorone diisocyante are particularly preferable.

Polyurea can be synthesized by polyaddition of a polyamine and a polyisocyanate. Among these, a polyurea synthesized by reacting a diamine and a diisocyanate is preferable.

As polyisocyanates, a single use of a diisocyanate is suitable and a combination use of a diisocyanate and a tri- or higher iscoaycnate.

As polyisocyanates, the same as the case of the polyurethane can be used.

As polyamines, a single use of a diamine is suitable and a combination use of a diamine and a tri- or higher amine.

There is no specific limit to the polyamine.

Specific examples thereof include, but are not limited to, aliphatic polyamines and aromatic polyamines.

Among these, aliphatic polyamines having 2 to 18 carbon atoms and aromatic polyamines having 6 to 20 carbon atoms are preferable.

Specific examples of the aliphatic polyamines having 2 to 18 carbon atoms include, but are not limited to, alkylene diamines having 2 to 6 carbon atoms such as ethylene diamine, propylene diamine, trimethylene diamine, tetramethylene diamine, and hexamethylene diamine; polyalkylene diamines having 4 to 18 carbon atoms such as diethylene triamine, iminobis propyl amine, bis(hexamethylene)triamine, triethylene tetramine, tetraethylene pentamine, and pentamethylene hexamine; alkyl substituted compounds of alkylene diamine or polyalkylene diamine in which the number of carbon atoms of the alkyl is from 1 to 4 or hydroxyalkyl substituted compounds of alkylene diamine or polyalkylene diamine in which the number of carbon atoms of the hydroxyalkyl is from 2 to 4 such as dialkyl aminopropyl amine, trimethyl hexamethylene diamine, aminoethyl ethanol amine, 2,5-dimethyl-2,5-hexamethylene diamine, and methyl iminobis(propyl amine); alicyclic diamines having 4 to 15 carbon atoms such as 1,3-diamino cyclohexane, isophorone diamine, menthene diamine, 4,4'-methylene dicyclohexane diamine (hydrogenated methylene dianiline; heterocyclic aliphatic diamines having 4 to 15 carbon atoms such as piperazine, N-aminoethyl piperazine, 1,4-diaminoethyl piperazine, 1,4,-bis(2-amino-2-methylpropyl) piperazine, 3,9-bis(3-aminopropyl)-2,4,8,10-tetraoxaspiro[5,5]undecane; and aromatic ring-containing aliphatic diamines having 8 to 15 carbon atoms such as xylylene diamine, and tetrachlor-p-xylylene diamine.

Specific examples of the aromatic diamines having 6 to 20 carbon atoms include, but are not limited to, non-substituted aromatic diamines such as 1,2-phenylene diamine, 1,3-phenylene diamine, 1,4-phenylene diamine, 2,4,'-diphenyl methane diamine, 4,4'-diphenyl methane diamine, crude diphenyl methane diamine (polyphenyl polymethylene polyamine), diaminodiphenyl sulfone, bendidine, thiodianiline, bis(3,4-diaminophenyl) sulfone, 2,6-diaminopilidine, m-aminobenzyl amine, triphenyl methane-4,4',4"-triamine, and naphtylene diamine; aromatic diamines having a nuclear substitution alkyl group having one to four carbon atoms such as 2,4- or 2,6-tolylene diamine, crude tolylene diamine, diethyle tolylene diamine, 4,4'-diamino-3,3'-dimethyldiphenyl methane, 4,4'-bis(o-toluidine), dianisidine, diamino ditolyl sulfone, 1,3-dimethyl-2,4-diaminobenzene, 1,3-dimethyl-2,6-diaminobenzene, 1,4-diisopropyl-2,5-diamino benzene, 2,4-diamino mesitylene, 1-methyl-3,5-diethyl-2,4-diamino benzene, 2,3-dimethyl-1,4-diamino naphthalene, 2,6-dimethyl-1,5-diamino naphthalene, 3,3',5,5'-tetramethyl bendizine, 3,3',5,5'-tetramethyl-4,4'-diamino diphenyl methane, 3,5-diethyl-3'-methyl-2',4-diamino diphenyl methane, 3,3'diethyl-2,2'-diaminodiphenyl methane, 4,4'-diamino-3,3'-dimethyl diphenylmethane, 3,3',5,5'-tetraethyl-4,4'-diaminobenzophenone, 3,3',5,5'-tetraethyl-4,4'-diaminodiphenyl ether, 3,3',5,5'-tetraisopropyl-4,4'-diaminophenyl sulfone; aromatic diamines having a nuclear substitution electron withdrawing group (such as halogen (e.g., Cl, Br, I, and F), alkoxy groups such as methoxy group and ethoxy group, and nitro group) such as methylene bis-o-chloroaniline, 4-chlor-o-phenylene diamine, 2-chlor-1,4-phenylene diamine, 3-amino-4-chloroaniline, 4-bromo-1,3-phenylene diamine, 2,5-dichlor-1,4-phenylene diamine, 5-nitro-1,3-phenylene diamine, 3-dimethoxy-4-aminoaniline; 4,4'-diamino-3,3'-dimethyl-5,5'-dibromo-diphenyl methane, 3,3'-dichlorobenzidine, 3,3'dimethoxy benzidine, bis(4-amino-3-chlorophenyl)oxide, bis(4-amino-2-chlorophenyl)propane, bis(4-amino-2-chlorophenyl)sulfone, bis(4-amino-3-methoxyphenyl) decane, bis(4-aminophenyl)sulfide, bis(4-aminophenyl)telluride, bis(4-aminophenyl)selenide, bis(4-amino-3-methoxyphenyl)disulfide, 4,4'-methylene bis(2-iodoaniline), 4,4'-methylene bis(2-bromoaniline), 4,4'-methylene bis(2-fluoroaniline), 4-aminophenyl-2-chloroaniline); aromatic diamines having a secondary amino group such as the non-substituted aromatic diamines specified above, the aromatic diamines having a nuclear substitution alkyl group having one to four carbon atoms, compounds in which part or entire of the primary amine group of the aromatic diamines having a nuclear substitution electron withdrawing group specified above is substituted with a lower alkyl group such as methyl group and ethyl group to be a tertiary amino group, 4-4'-di(methylamino)diphenyl methane, and 1-methyl-2-methylamino-4-aminobenzene.

In addition to those, specific examples of the other diamines include, but are not limited to, polyamide polyamines synthesized by condensation of dicarboxylix acid (e.g., dimeric acid) and excessive (2 mols or more of dicarboxylic acid per mol of acid) polyamines (e.g., alkylene diamines and polyalkylene polyamines) and polyether polyamines such as hydrogenated compounds of cyanoethylated polyether polyols (e.g., polyalkylene glycol).

Blocked ketimine or oxazoline compounds in which the amine group of the polyamine is blocked with ketone such as acetone, methylethyl ketone, and methylisobutyl ketone can be used instead of the polyamine.

It is possible to obtain a urethane-modified polyester resin by reacting a prepolymer having an isocyanate group at its end with a polyol.

It is possible to obtain a urea-modified polyester resin by reacting a prepolymer having an isocyanate group at its end with a polyamine.

As the polyol, a single use of a diol is suitable and a combination use of a diol and a tri- or higher alcohol.

As the polyol, the same as the case of polyurethane can be used.

As polyamines, a single use of a diamine is suitable and a combination use of a diamine and a tri- or higher amine.

As polyamine, the same as the case of polyurea can be used.

There is no specific limit to the selection of the prepolymer having an isocyanate group at its end.

Specific examples thereof include, but are not limited to, polyester prepolymers having an isocyanate group at its end, polyurethane prepolymers having an isocyanate group at its end, polyurea prepolymers having an isocyanate group at its end, polyamide prepolymers having an isocyanate group at its end, and polyether prepolymers having an isocyanate group at its end.

Among these, polyurethane prepolymers having an isocyanate group at its end is preferable.

It is possible to synthesize a polyester prepolymer having an isocyanate group at its end by reacting a polyester diol and a diisocyanate.

As diisocyanates, the same as the polyurethane can be used.

Polyester diol can be synthesized by polycondensation of a polyol and a polycarboxylic acid, ring-opening polymerization of a lactone, polycondensation of a hydroxycarboxylic acid, or ring-opening polymerization of a ring ester.

Among these, a polyester diol synthesized by reacting a diol and a dicarboxylic acid is preferable.

As the polyol, a single use of a diol is suitable and a combination use of a diol and a tri- or higher alcohol.

As the polyol, the same as the case of polyurethane can be used.

As polycarboxylic acids, a single use of a dicarboxylic acid is suitable and a combination use of a dicarboxylix acid and a tri- or higher carboxylic acid.

There is no specific limit to the dicarboxylic acid.

Specific examples thereof include, but are not limited to, aliphatic dicarboxylic acids such as straight chain type aliphatic dicarboxylic acids and the branch-chained type aliphatic dicarboxylic acids, and aromatic dicarboxylic acids.

Among these, using the straight chain type aliphatic dicarboxylic acids is preferable.

Specific examples of the aliphatic dicarboxylic acids include, but are not limited to, alkane dicarboxylic acids having 4 to 36 carbon atoms such as succinic acid, adipic acid, sebacic acid, azelaic acid, dodecane dicarboxylic acid, octadecane dicarboxylic acid, and decyl succinic acid; alkenyl succinic acids such as dodecenyl succinic acid, pentadecenyl succinic acid, and octadecenyl succinic, alkene dicarboxylic acids having 4 to 36 carbon atoms such as maleic acid, fumaric acid, and citraconic acid, and alicyclic dicarboxylic acids having 6 to 40 carbon atoms such as dimer acid (dimerized linolic acid).

Specific examples of the aromatic dicarboxylic acids include, but are not limited to, aromatic dicarboxylic acids having 8 to 36 carbon atoms such as phthalic acid, isophthalic acid, terephthalic acid, t-butyl isophthalic acid, 2,6-naphthalene dicarboxylic acid, and 4,4'-biphenyl dicarboxylic acid.

There is no specific limit to the polycarboxylic acids having three or more hydroxyl groups.

Specific examples thereof include, but are not limited to, aromatic polycarboxylic acids having 9 to 20 carbon atoms (e.g., trimellitic acid and pyromellitic acid).

In addition, instead of polycarboxylic acid, anhydrides of polycarboxylic acid or lower alkyl esters (e.g., methyl esters, ethyl esters or isopropyl esters) can be used.

Among these, it is preferable to use the aliphatic dicarboxylic acids.

It is more preferable to use adipic acid, sebacic acid, dodecane dicarboxylic acid, terephthalic acid, and isophthalic acid singly.

It is also preferable to use an aliphatic dicarboxylic acid and an aromatic dicarboxylic acid or a lower alkyl ester thereof in combination.

It is more preferable to use terephthalic acid, isophthalic acid, t-butyl isophthalic acid or a lower alkyl ester thereof in combination.

The content of aromatic dicarboxylic acid in dicarboxylic acid is preferably 20% by mol or less.

There is no specific limit to the lactone.

Specific examples thereof include, but are not limited to, monolactones having 3 to 12 carbon atoms such as β-propiolactone, γ-butylolactone, δ-valerolactone, and ϵ-caprolactone.

Among these, ϵ-caprolactone is preferable.

A catalyst such as a metal oxide and an organic metal compound can be used at ring-opening polymerization of a lactone.

A diol such as ethylene glycol and diethylene glycol can be used as an initiator.

Specific examples of products of polyester synthesized by ring-opening polymerization of a lactone available from the market include, but are not limited to, H1P, H4, H5, and H7 of PLACCEL SERIES (manufactured by DAICEL CORPORATION).

There is no specific limit to the hydroxycarboxylic acid.

Specific examples thereof include, but are not limited to, glycolic acid and lactic acid (L-, D- and racemic form).

There is no specific limit to the selection of the cyclic ester.

Specific examples thereof include, but are not limited to, cyclic esters having 4 to 12 carbon atoms corresponding to a two or three molecule dehydrocondensed compound of a hydroxycarboxylic acid such as glycolide and lactide (L-, D- and racemic form).

Among these, preferable cyclic esters are L-lactide and D-lactide.

A catalyst such as a metal oxide and an organic metal compound can be used at ring-opening polymerization of a cyclic ester.

A polyester diol can be synthesized by modifying a polyester synthesized by polycondensation of a hydroxycarboxylic acid or ring-opening polymerization of a cyclic ester in such a manner that the end is a hydroxyl group.

It is possible to synthesize a polyamide prepolymer having an isocyanate group at its end by reacting a polyamide amine and a diisocyanate.

As diisocyanates, the same as the polyurethane can be used.

Polyamide diamine can be synthesized by polycondensation of a polyamine and a polycarboxylic acid.

Among these, polyamide diamine synthesized by polycondensation of diamine and a dicarboxylic acid.

As polyamines, a single use of a diamine is suitable and a combination use of a diamine and a tri- or higher amine.

As polyamine, the same as the case of polyurea can be used.

As polycarboxylic acids, a single use of a dicarboxylic acid is suitable and a combination use of a dicarboxylix acid and a tri- or higher carboxylic acid.

As polycarboxylic acids, the same as the polyester can be used.

It is possible to synthesize a polyester prepolymer having an isocyanate group at its end by reacting a polyester diol and a diisocyanate.

As diisocyanates, the same as the case of polyurethane can be used.

There is no specific limit to the polyether diol.

A specific example thereof is a polyoxy alkylene polyol.

There is no specific limit to the manufacturing method of the polyoxyalkylene polyol.

For example, Journal of the American Chemical Society published in 1956 described a method of ring-opening polymerization of a chiral alkylene oxide (AO) using a catalyst in pages from 4,787 to 4,792 in No. 18, Vol. 78.

The method of ring-opening a racemic alkylene oxide is also usable.

As specific methods of ring-opening a racemic alkylene oxide, JP-H11-12353-A describes a method using a compound obtained by contacting a lanthanoid complex and an organic aluminum as a catalyst and JP-2001-521957-A describes a method of preliminarily conducting reaction between bimetal μ-oxo alkoxide and a hydroxyl compound.

Also, Journal of the American Chemical Society published in 2005 described a suitable method using a salen complex as a catalyst to obtain a crystalline polyoxyalkylene polyol having a high isotacticity in pages from 11,566 to 11,567 in No. 33, Vol. 127. For example, when using a diol or water as an initiator during ring-opening polymerization of a chiral alkylene oxide, a polyoxyalkylene glycol having a hydroxyl group at its end with 50% or more isotacticity can be synthesized.

When the isotacticity is 50% or more, the obtained product is normally crystalline.

The same diol as for the polyurethane can be used.

There is no specific limit to the alkylene oxide.

Specific examples thereof include, but are not limited to, alkylene oxides having three to nine carbon atoms such as propylene oxide, 1-chlorooxetane, 2-chlorooxetane, 1,2-dichlorooxetane, epichlorohydrin, epibromohydrin, 1,2-butylene oxide, methyl glycidyl ether, 1,2-penthylene oxide, 2,3-penthylene oxide, 3-methyl-1,2-butylene oxide, cyclohexene oxide, 1,2-hexylene oxide, 3-methyl-1,2-pentylene oxide, 2,3-hexylene oxide, 4-methyl-2,3-penthylene oxide, aryl glycidyl ether, 1,2-heptylene oxide, styrene oxide, and phenyl glycidyl ether.

These can be used alone or in combination.

Among these alkylene oxides, it is preferable to use propylene oxide (PO),1,2-butylene oxide (BO), styrene oxide, and cyclohexene oxide and, more preferable, PO, 1,2-BO, and cyclohexene oxide.

The isotacticity of polyoxyalkylene polyol is normally 70% or higher, preferably 80% or higher, more preferably 90% or more, and furthermore preferably 95%.

The isotacticity in the present disclosure can be calculated by, for example, the method described in pages from 2,389 to 2,392 of No. 6, Vol. 35, Macromolecules published in 2002.

The crystalline resin can be a block copolymer having a crystalline block and a non-crystalline block.

There is no specific limit to the selection of the block constituting the block copolymer.

Specific examples thereof include, but are not limited to, a polyester block, a polyurethane block, a polyurea block, a polyamide block, and a polyether block.

The block copolymer is preferably a polyurethane having a polyester block and a polyurethane block.

The content of the polyester block in polyurethane is preferably from 50% by weight to 98% by weight, more preferably from 60% by weight to 98% by weight, and furthermore preferably from 70% by weight to 95% by weight.

When the content of the polyester block in polyurethane is too low, the low-temperature fixability and the high-temperature stability of toner tend to deteriorate.

By contrast, when the content is too high, the hot offset resistance may deteriorate.

The maximum endothermic peak temperature of the crystalline resin in the second temperature rising is preferably from 45° C. to 70° C., preferably from 53° C. to 65° C., and more preferably from 58° C. to 62° C.

When the maximum endothermic peak temperature of the crystalline resin in the second temperature rising is too low, the high-temperature stability of the toner tends to deteriorate and when the maximum endothermic peak temperature is too high, the low-temperature fixability of the toner tends to deteriorate.

The ratio of the maximum endothermic peak of the crystalline resin in the second temperature rising to the softening temperature of the crystalline resin is from 0.80 to 1.60, preferably from 0.85 to 1.40, more preferably from 0.9 to 1.30, and particularly preferably from 0.9 to 1.25.

When the ratio of the maximum endothermic peak of the crystalline resin in the second temperature rising to the softening temperature of the crystalline resin is too low, the hot offset resistance of the toner tends to deteriorate and when the ratio is too high, the low-temperature fixability and the high-temperature stability of the toner tend to deteriorate.

The storage elastic modulus G' of the crystalline resin at a temperature 20° C. higher than the maximum endothermic peak temperature in the second temperature rising is from $5.0\times10^6$ Pa·s or less, preferably from $1.0\times10^1$ Pa·s to $5.0\times10^5$ Pa·s, and more preferably from $1.0\times10^1$ Pa·s to $1.0\times10^4$ Pa·s.

The loss elastic modulus G" of the crystalline resin at a temperature 20° C. higher than the maximum endothermic peak temperature in the second temperature rising is preferably $5.0\times10^6$ Pa·s or less, more preferably from $1.0\times10^1$ Pa·s to $5.0\times10^5$ Pa·s, and furthermore preferably from $1.0\times10^1$ Pa·s to $1.0\times10^4$ Pa·s.

The storage elastic modulus G' and the loss elastic modulus G" can be measured by a dynamic viscoelasticity measuring device.

The weight average molecular weight of the crystalline resin is from 2,000 to 100,000, preferably from 5,000 to 60,000, and more preferably from 8,000 to 30,000.

When the weight average molecular weight of the crystalline resin is too low, the hot offset resistance of the toner may deteriorate.

When the weight average molecular weight is too high, the low-temperature fixability may deteriorate.

The weight average molecular weight is a molecular weight in conversion of polystyrene measured by using gel permeation chromatography (GPC).

The crystalline resin preferably has a first crystalline resin and a second crystalline resin having a weight average molecular weight (Mw) greater than that of the first crystalline resin. By imparting the low-temperature fixing property to the first crystalline resin and the hot offset resistance to the second crystalline resin, the two competing characteristics can be functionally separated, so that a toner having a wide temperature range with regard to fixing can be obtained.

In addition, the second crystalline resin is preferably a resin obtained by elongating the modified crystalline resin having an isocyanate group.

This is advantageous to form a crystalline resin having a high molecular weight in the binder resin.

The second crystalline resin is preferably a resin obtained by elongating a modified crystalline resin having a functional group reactive with an active hydrogen group prepared by modifying the first crystalline resin.

The second crystalline resin is uniformly finely-dispersed in the binder resin so that a toner having an excellent combination of the low-temperature fixing property and the hot offset resistance is obtained.

The binder resin may contain a urea-modified crystalline polyurethane.

The urea-modified crystalline polyurethane is obtained by conducting reaction of a polyamine and a prepolymer serving as a precursor of the binder resin, which has an isocyanate group at its end deriving from a crystalline polyurethane in the manufacturing process of toner.

The binder resin may contain a non-crystalline resin.

There is no specific limit to the non-crystalline binder resin.

Specific examples thereof include, but are not limited to, styrene polymers and substituted styrene polymers such as polystyrene, poly-p-styrene, and polyvinyltoluene; styrene copolymers such as styrene-p-chlorostyrene copolymers, styrene-propylene copolymers, styrene-vinyltoluene copolymers, styrene-methyl acrylate copolymers, styrene-ethyl acrylate copolymers, styrene-methacrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ether copolymers, styrene-vinyl methyl ketone copolymers, styrene-butadiene copolymers, styrene-isoprene copolymers, and styrene-maleic acid ester copolymers; and other resins such as polymethyl methacrylate, polybutyl methacrylate, polyvinyl chloride, polyvinyl acetate, polyethylene, polyesters, epoxy resins, polyurethane resins, polyvinyl butyral resins, polyacrylic resins, rosin, modified rosins, terpene resins, phenol resins, aliphatic or aromatic hydrocarbon resins, aromatic petroleum resins, urethane-modified polyester, urea-modified polyesters, urethane-modified polyamide, urea-modified polyamide, urethane-modified vinyl resins, urea-modified vinyl resins, urethane-modified polyether, urea-modified polyether, urea-modified polyurethane, and urethane-modified polyurea.

These resins can be used alone or in combination.

There is no specific limit to the coloring agent.

Specific examples thereof include, but are not limited to, known dyes and pigments such as carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red FSR, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like.

These materials can be used alone or in combination.

Specific examples of the black coloring agents include, but are not limited to, carbon black (C.I. Pigment Black 7) such as furnace black, lamp black, acetylene black, and channel black, metals such as copper, iron (C.I. Pigment Black 11), and titanium oxides, and organic pigments such as aniline black (C.I. Pigment Black 1).

Specific examples of the coloring agents for magenta include, but are not limited to, C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, and 211; C.I. Pigment Violet 19; C.I. Vat Red 1, 2, 10, 13, 15, 23, 29, and 35.

Specific examples of the coloring agents for cyan include, but are not limited to, C.I. Pigment Blue 2, 3, 15, 15:1, 15:2, 15:3, 15:4, 15:6, 16, 17, 60; C.I. Vat Blue 6; C.I. Acid Blue 1; Copper phthalocyanine pigments in which one to five phthal imidemethyl groups are substituted in the phthalocyanine skeleton; and Green 7 and Green 36.

Specific examples of the coloring agents for yellow include, but are not limited to, C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, 180; C.I. Vat Yellow 1, 3, and 20; and Orange 36.

The content of the coloring agent in the toner is from 1% by weight to 15% by weight and preferably from 3% by weight to 10% by weight.

When the content of the coloring agent in the toner is too small, the coloring performance of the toner tends to deteriorate.

To the contrary, when the content of the coloring agent is too great, the coloring performance and the electric characteristics of the toner easily deteriorate.

The pigment and the crystalline resin and/or the non-crystalline resin can be used in combination as a master batch.

The master batch can be manufactured by mixing and kneading a crystalline resin and/or a non-crystalline resin with a pigment by applying a shearing force using a high shearing disperser such as a three roll mill.

It is possible to add an organic solvent to boost the interaction between the pigment and the crystalline resin and/or the non-crystalline resin.

Also, it is possible to use a wet cake of the pigment as it is.

Using a so-called flushing method is preferable because drying is not necessary.

In the flushing method, a water paste containing a pigment and a crystalline resin and/or a non-crystalline resin is mixed and/or kneaded with an organic solvent and the pigment is transferred to the crystalline resin and/or the non-crystalline resin side to remove water and the organic solvent.

In the organic-modified inorganic laminate compound, organic ions are at least partially substituted for ions present between layers of the organic-modified inorganic laminate compound.

There is no specific limit to the laminate inorganic compounds.

Specific examples thereof include, but are not limited to, smectite group clay minerals such as montmorillonite, saponite, and hectorite; kaolin group clay minerals such as kaolinite; bentonite, attapulgite, magadiite, and kanemite.

These can be used alone or in combination.

Among these, montmorillonite is preferable.

There is no specific limit to the organic ions.

Specific examples thereof include, but are not limited to, quaternary ammonium ion; phosphonium ion; imidazolium ion; and sulfuric acid ion, sulfonic acid ion, carboxylic acid ion, and phosphoric acid ion which have a branched-, non-branched, or cyclic alkyl skeleton having 4 to 44 carbon atoms, a branched-, non-branched, or cyclic alkenyl skeleton having 1 to 22 carbon atoms, branched-, non-branched, or cyclic alkoxy skeleton having 8 to 32 carbon atoms, branched-, non-branched, or cyclic hydroxy alkyl skeleton having 2 to 22 carbon atoms, ethylene oxide skeleton, or a propylene oxide skeleton.

Among these, quaternary ammonium ions are preferable.

Specific examples of the quaternary ammonium ion include, but are not limited to, trimethyl stearyl ammonium ion, dimethyl stearyl benzyl ammonium ion, dimethyl octadecyl ammonium ion, and oleyl bis(2-hydroxyethyl)methyl ammonium ion.

An organically modified laminate inorganic compound is also suitable in which at least part of the divalent metal ion present between the layers is substituted by a trivalent metal ion to introduce an inorganic anion and at least part of the inorganic anion is substituted by an organic anion.

Specific examples of the marketed products of the organic-modified laminate inorganic compounds include, but are not limited to, quaternium 18/bentonite such as BENTONE 3, BENTONE 38 (both manufactured by RHEOX INTERNATIONAL INCORPORATED), THIXOGEL VP (manufactured by UNITED CATALYST), CLAYTONE 34, CLAYTONE 40, and CLAYTONE XL (manufactured by SOUTHERN CLAY PRODUCTS, INC.); stearalconium bentonite such as BENTONE 27 (manufactured by RHEOX INTERNATIONAL INCORPORATED), THIXOGELI LG (manufactured by united catalyst), CLAYTONE AF and CILAYTONE APA (manufactured by SOUTHERN CLAY PRODUCTS, INC.); QUANTERNIUM 18/benzalconium bentonite such as CLAYTONE HT and CILAYTONE PS (manufactured by SOUTHERN CLAY PRODUCTS, INC.); organically modified montmorillonite such as CLAYTONE HY (manufactured by SOUTHERN CLAY PRODUCTS, INC.); and organic-modified smectites such as LUCENTITE SPN (manufactured by CO-OP CHEMICAL CO., LTD.).

An organically modified laminate inorganic compound is included in which organic anions represented by Chemical Structure A, are at least partially substituted for anions present between layers of DHT-4A (manufactured by KYOWA CHEMICAL INDUSTRY CO., LTD.).

$R_1(OR_2)_2OSOO_3^-$ Chemical Structure A

In Chemical Structure A, $R_1$ represents an alkyl group having 13 carbon atoms, $R_2$ represents an alkylene group having 2 to 6 carbon atoms, and n represents an integer of from 2 to 10.

A specific example of the product represented by Chemical Structure A available from the market is HITENOL 330T (manufactured by Dai—Ichi Kogyo Seiyaku Co., Ltd.).

The organically modified laminate inorganic compounds can be used in combination with a resin as a master batch like the pigment.

The content of the organically modified laminate inorganic compounds in the toner is from 0.1% by weight to 3.0% by weight, preferably from 0.5% by weight to 2.0% by weight, and more preferably from 1.0% by weight to 1.5% by weight.

When the content of the organically modified laminate inorganic compounds in the toner is too small, the stress resistance of the toner tends to deteriorate.

By contrast, when the content is too large, the low-temperature fixability of the toner easily deteriorates.

The toner may contain a releasing agent, a charge control agent, a fluidity improver, and a cleanability improver.

There is no specific limit to the releasing agent.

Specific examples thereof include, but are not limited to, waxes having a carbonyl group, polyolefin waxes, and a long-chain hydrocarbons.

These can be used alone or in combination.

Among these waxes, the waxes including a carbonyl group are preferable.

Specific examples of the waxes including a carbonyl group include, but are not limited to, polyalkane acid esters such as carnauba wax, montan waxes, trimethylolpropane tribehenate, pentaerythritol tetrabehenate, pentaerythritol diacetate dibehenate, glycerin tribehenate, and 1,18-octadecanediol distearate; polyalkanol esters such as trimellitic acid tristearyl, and distearyl maleate; polyalkane acid amides such as dibehenyl amide; polyalkylamide such as trimellitic acid tristearylamide; dialkyl ketones such as distearyl ketone, etc.

Among these waxes, polyalkane acid esters are preferable.

Specific examples of the polyolefin waxes include, but are not limited to, polyethylene waxes and polypropylene waxes.

Specific examples of the long-chain hydrocarbons include, but are not limited to, paraffin wax and sazol wax.

The melting point of the releasing agent is from 40° C. to 160° C., more preferably from 50° C. to 120° C., and particularly preferably from 60° C. to 90° C.

When the melting point of the releasing agent is too low, the high-temperature storage of the toner may deteriorate.

When the melting point is too high, the cold-offset resistance of the toner may deteriorate.

The melting point of the releasing agent can be measured by a differential scanning calorimeter (for example, DSC210, manufactured by SEIKO ELECTRONICS INDUSTRIAL CO., LTD.).

To be specific, raise the temperature of a sample to 200° C., cool it down to 0° C. at a temperature descending speed of 10° C./min. and raise the temperature at a temperature rising speed of 10° C./min.

The releasing agent has a melt viscosity of from 5 cps to 1,000 cps and preferably from 10 cps to 100 cps at a temperature 20° C. higher than the melting point of the releasing agent.

A melt viscosity that is too low may cause degradation of the releasability of the toner.

By contrast, a melt viscosity that is too high may cause degradation of the hot offset resistance and the low-temperature fixability of the toner.

The content of the releasing agent in the toner is from 0% by weight to 40% by weight and preferably from 3% by weight to 30% by weight.

When the content of the releasing agent in the toner is too large, the fluidity of the toner may deteriorate.

There is no specific limit to the charge control agents.

Specific examples thereof include, but are not limited to, triphenylmethane dyes, chelate pigments of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing surface active agents, metal salts of salicylic acid, metal salts of derivatives of salicylic acid, quinacridone, azo-based pigments, and polymer compounds having a functional group such as a sulfonate group, a carboxyl group, or a quaternary ammonium basic group. These can be used alone or in combination.

Specific examples of the marketed products of the charge control agents include, but are not limited to, BONTRON P-51 (quaternary ammonium salt), E-82 (metal complex of oxynaphthoic acid), E-84 (metal complex of salicylic acid), and E-89 (phenolic condensation product), all of which are manufactured by Orient Chemical Industries Co., Ltd.; TP-302 and TP-415 (molybdenum complex of quaternary ammonium salts), which are manufactured by Hodogaya Chemical Co., Ltd.; COPY CHARGE PSY VP2038 (quaternary ammonium salt), COPY BLUE PR (triphenyl methane derivative), COPY CHARGE NEG VP2036 and NX VP434 (quaternary ammonium salt), all of which are manufactured by Hoechst AG; LRA-901, and LR-147 (boron complex), which are manufactured by Japan Carlit Co., Ltd.

The mass ratio of the charge control agent in the binder resin is from 0.1% by weight to 10% by weight, and more preferably from 0.2% by weight to 5% by weight.

When the mass ratio of the charge control agent to the binder resin is too small, the chargeability of the toner tends to deteriorate.

When the mass ratio of the charge control agent to the binder resin is too large, the fluidity of the toner tends to deteriorate and the image density easily lowers.

There is no specific limit to the selection of the fluidizer.

Specific examples thereof include, but are not limited to, metal oxide particles such as silica particles, titanium oxide particles, alumina particles, tin oxide particles, and antimony oxide particles, hydrophobized metal oxide particles, and fluorine-containing resin particles.

These can be used alone or in combination.

Among these, hydrophobized silica particles, hydrophobized titanium oxide particles, and hydrophobized alumina particles are preferable.

Specific examples of the marketed products of the silica particles include, but are not limited to, HDK H 2000, HDK H 2000/4, HDK H 2050 EP, HVK21, HDK H 1303, (all manufactured by Hoechst AG), R972, R974, RX200, RY200, R202, R805, and R812 (manufactured by NIPPON AEROSIL CO., LTD.).

Specific examples of the marketed products of titania include, but are not limited to, P-25 (manufactured by NIPPON AEROSIL CO., LTD.), STT-30, STT-65C-S (manufactured by TITAN KOGYO LTD.), TAF-140 (manufactured by FUJI TITANIUM INDUSTRY CO., LTD.), MT-150W, MT-500B, MT-600B, and MT-150A (manufactured by TAYCA CORPORATION).

Specific examples of the hydrophobized titania particles available from the market include, but are not limited to, T-805 (manufactured by Nippon Aerosil Co., Ltd.), STT-30A, STT-65C-S (manufactured by TITAN KOGYO LTD.), TAF-500T, TAF-1500T (manufactured by FUJI TITANIUM INDUSTRY CO., LTD.), MT-100S, MT-100T (manufactured by TAYCA CORPORATION). and IT-S (manufactured by ISHIHARA SANGYO KAISHA, LTD.).

There is no specific limit to the method of manufacturing the hydrophobized metal oxide particles.

Specific examples thereof include, but are not limited to, a method of treating the metal oxide particles with a silane coupling agent and a method of treating the metal oxide particles with silicone oil.

Specific examples of the silane coupling agents include, but are not limited to, methyl trimethoxy silane, methyl triethoxy silane, octyl trimethoxy silane, and amino silane coupling agents.

Specific examples of the silicone oil include, but are not limited to, dimethyl silicone oil, methylphenyl silicone oil, chlorophenyl silicone oil, methylhydrogene silicone oil, alkyl-modified silicone oil, fluorine-modified silicone oil, polyether-modified silicone oil, alcohol-modified silicone oil, amino-modified silicone oil, epoxy-modified silicone oil, epoxy/polyether silicone oil, phenol-modified silicone oil, carboxyl-modified silicone oil, mercapto-modified silicone oil, acryl-modified silicone oil, methacryl-modified silicone oil, and α-methylstyrene-modified silicone oil.

The content of the fluidity improver in the toner is preferably from 0.1% by weight to 5% by weight and more preferably from 0.3% by weight to 3% by weight.

The primary particle diameter of the metal oxide particles is preferably from 1 nm to 100 nm and more preferably from 5 nm to 70 nm.

When the primary particle average particle diameter of the metal oxide particles is too small, the fluidity improver may be embedded in the toner.

When the primary particle average particle diameter is too large, the surface of the image bearing member may be damaged.

Any known cleaning property improver can be suitably used.

Specific examples thereof include, but are not limited to, aliphatic metal salts such as zinc stearate and calcium stearate; resin particles such as polymethacrylate particles, and polystyrene particles.

The weight average particle diameter of the cleanability improver is from 0.01 μm to 1 μm.

The content of the cleanability improver in the toner is from 0.01% by weight to 5% by weight and preferably from 0.1% by weight to 2% by weight.

The maximum endothermic peak temperature of the toner in the second temperature rising is from 45° C. to 75° C., preferably from 53° C. to 70° C., and more preferably from 58° C. to 65° C.

When the maximum endothermic peak temperature of the toner in the second temperature rising is too low, the high-temperature stability of the toner tends to deteriorate and when the maximum endothermic peak temperature is too high, the low-temperature fixability of the toner tends to deteriorate.

The amount of melting heat of the toner in the second temperature rising is from 30 J/g to 75 J/g, preferably from 45 J/g to 70 J/g, and more preferably from 50 J/g to 60 J/g.

When the amount of melting heat of the toner in the second temperature rising is too low, the high-temperature stability of the toner may deteriorate.

When the amount of melting heat is too large, the low-temperature fixability may deteriorate.

The amount of melting heat in the second temperature rising can be measured by a differential scanning calorimeter (DSC).

The toner containing a crystalline resin is crystallized in the transfer process after melted on the recording medium in the fixing process.

When the crystallization temperature of the crystalline resin is too low, the image may be damaged while being transferred in the paper path by friction with the transfer members because the crystalline resin is not quickly crystallized.

The toner preferably satisfies the relation: Td−Td'≤30, more preferably the relation: Td−Td'≤25, and furthermore preferably the relation: Td−Td'≤20, where Td (° C.) represents the endothermic peak temperature in the second temperature rising and Td' (° C.) represents the maximum exothermic peak in the first temperature descending.

In addition, the toner satisfies the relation: Td'≥30, preferably the relation: Td'≥35, and more preferably the relation: Td'≥40.

Td' is equal to or lower than Td and normally 55° C. or lower.

The maximum exothermic peak temperature of the first temperature rising can be measured by a differential scanning calorimeter (DSC).

The ratio of the softening temperature of the toner to the maximum endothermic peak temperature thereof in the second temperature rising is preferably from 0.80 to 1.60, more preferably from 0.85 to 1.40, furthermore preferably from 0.9 to 1.30, and particularly preferably from 0.90 to 1.25.

When the ratio of the softening temperature of the toner to the maximum endothermic peak temperature thereof in the second temperature rising is too low, the hot offset resistance of the toner tends to deteriorate and when the ratio is too high, the low-temperature fixability and the high-temperature stability of the toner tend to deteriorate.

The storage elastic modulus G' of the toner at a temperature 20° C. higher than the maximum endothermic peak temperature in the second temperature rising is preferably from $1.0\times10^3$ Pa·s to $5.0\times10^6$ Pa·s and more preferably from $1.0\times10^4$ Pas to $5.0\times10^5$ Pa·s.

The storage elastic modulus G" of the toner at a temperature 20° C. higher than the maximum endothermic peak temperature in the second temperature rising is from $1.0\times10^3$ Pa·s to $5.0\times10^6$ Pa·s and preferably from $1.0\times10^4$ Pa·s to $5.0\times10^5$ Pa·s.

The ratio of the loss elastic modulus G" of the crystalline resin at a temperature 30° C. higher than the maximum endothermic peak temperature in the second temperature rising to the loss elastic modulus G" of the crystalline resin at a temperature 70° C. higher than the maximum endothermic peak temperature in the second temperature rising is preferably from 0.05 to 50, more preferably from 0.1 to 40, and furthermore preferably from 0.5 to 30.

The crystallinity of the toner is preferably from 15% or more, more preferably 20% or more, furthermore preferably 30% or more, and particularly preferably 45% or more.

In this range, the low-temperature fixability and the high-temperature stability are improved simultaneously.

The crystallinity of the toner can be calculated by the peak area ascribable to the crystalline structure of the binder resin and the halo area ascribable to the non-crystalline structure by using an X-ray diffraction device.

Figure 1B:
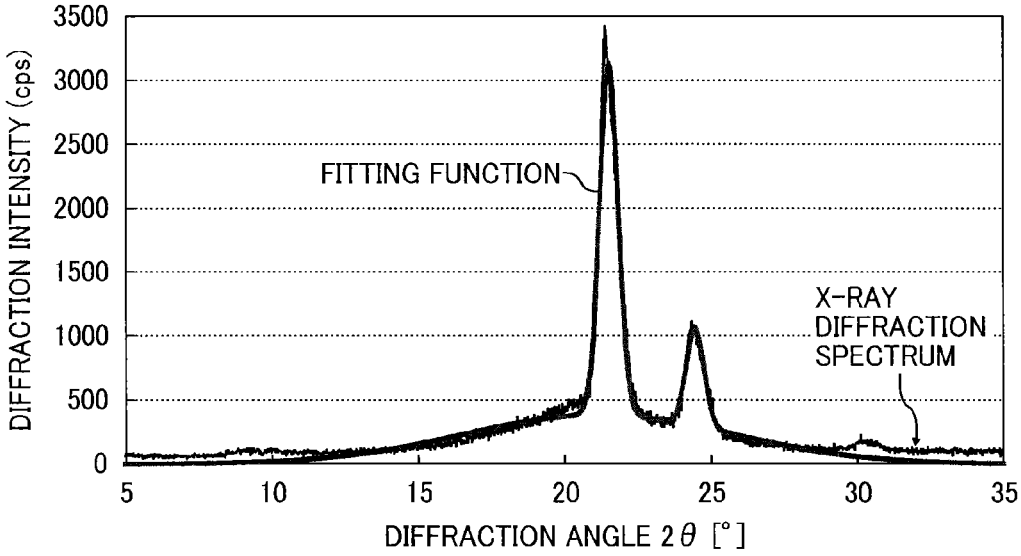

The method of calculating the crystallinity of the toner is described using FIGS. 1A and 1B.

In the X-ray diffraction spectrum illustrated in FIG. 1A, the main peaks of p1 and p2 are at diffraction angles of 2θ of 21.3° and 24.2°.

Halo (h) is observed in a wide range including these two peaks.

The main peaks are ascribable to the crystalline structure of the binder resin and, the halo, the non-crystalline structure thereof.

Gaussian function of these two main peaks and halo are as follows:

$$f_{p1}(2\theta)=a_{p1}\exp(-(2\theta-b_{p1})^2/(2c_{p1}^2))$$

$$f_{p2}(2\theta)=a_{p2}\exp(-(2\theta-b_{p2})^2/(2c_{p2}^2))$$

$$f_h(2\theta)=a_h\exp(-(2\theta-b_h)^2/(2c_h^2))$$

$f_{p1}(2\theta)$, $f_{p2}(2\theta)$, and $f_h(2\theta)$ are functions corresponding to the main peaks p1 and p2 and halo, respectively.

The sum of these three functions: $f(2\theta)=fp1(2\theta)+fp2(2\theta)+fh(2\theta)$ is defined as the fitting function of the entire X-ray diffraction spectrum as illustrated in FIG. 1B and fitting is conducted by the least-square approach.

The fitting functions in fitting are nine functions of $a_{p1}$, $b_{p1}$, $c_{p1}$, $a_{p2}$, $b_{p2}$, $C_{p2}$, $a_h$, $b_h$, and $c_h$.

As the initial values for fitting of each variable, the peak positions of the X-ray diffraction are assigned for $b_{p1}$, $b_{p2}$, and $b_h$ ($21.3=b_{p1}$, $24.2=b_{p2}$, $22.5=b_h$ in the example illustrated in FIGS. 1A and 1B) and suitable values are assigned for the other variables to make the two main peaks and the halo significantly match the X-ray diffraction spectrum.

Fitting may be conducted by, for example, SOLVER features of EXCEL 2003 manufactured by MICROSOFT CORPORATION.

The crystallinity (%) is calculated by assigning the areas ($S_{p1}$, $S_{p2}$, and $S_h$) calculated by Gaussian functions $f_{p1}(2\theta)$, $f_{p2}(2\theta)$, and $f_h(2\theta)$ corresponding to the two main peaks (pi) and (p2) and the halo, respectively, after the fitting, into the relation: $(S_{p1}+S_{p2})/(S_{p1}+S_{p2}+S_h)\times100$.

The content of the component having a molecular weight of 100,000 in the component of the toner soluble in tetrahydrofuran is preferably 5% or more, more preferably 7% or more, and furthermore preferably 9% or more.

By satisfying this range, it is possible to reduce the damage to the image caused during transfer in the paper path.

The content of the component having a molecular weight of 250,000 in the component of the toner soluble in tetrahydrofuran is preferably 0.5% or more.

By satisfying this range, it is possible to furthermore reduce the damage caused during transfer in the paper path.

The weight average molecular weight of the tetrahydrofuran-soluble component (i.e., component in the toner soluble in tetrahydrofuran) is preferably from 20,000 to 70,000, more preferably from 30,000 to 60,000, and furthermore preferably from 35,000 to 50,000.

When the weight average molecular weight of the component in the toner soluble in tetrahydrofuran is too low, the high-temperature stability of the toner may deteriorate.

When the weight average molecular weight of the component is too high, the low-temperature fixability may deteriorate.

The molecular weight of the component in the toner soluble in tetrahydrofuran is represented in polystyrene conversion measured by using gel permeation chromatography (GPC).

The content of the component having a molecular weight of 100,000 or 250,000 in the component of the toner soluble in tetrahydrofuran can be obtained by a cross section with the molecular weight of the integration molecular weight distribution curve of 100,000 or 250,000.

Specific examples of the method of manufacturing toner containing the component soluble in tetrahydrofuran having such a molecular weight distribution include, but are not limited to, a method of using two or more kinds of resins having different molecular weight distributions and a method of using a resin having a molecular weight distribution controlled in the polymerization.

In the case of using two or more kinds of resins having different molecular weight distributions, a resin having a relatively large molecular weight and a resin having a relatively small molecular weight are used.

A resin having a large molecular weight in the polymerization can be used or a resin having a large molecular weight formed by reaction between a prepolymer having an isocyanate group at its end deriving from a crystalline polyurethane and a polyamine is also suitable.

Of the two, the latter is preferable because a resin having a large molecular weight is present uniformly in the toner and dissolution in an organic solvent is easy in a chemical method.

The mass ratio of the polyester the resin having a large molecular weight to the polyester the resin having a small molecular weight is from 5/95 to 60/40, preferably from 8/92 to 50/50, more preferably from 12/88 to 35/65, and particularly preferably from 15/85 to 25/75.

A specific example of methods of synthesizing the resin having a molecular weight distribution controlled in the polymerization is polymerization of bi-functional monomers with a small amount of a monomer having a different number of functional groups.

The monomer having a different number of functional groups include tri- or higher monomers and a mono-functional monomer.

When using tri- or higher monomers, branch structures are produced, which may inhibit forming a crystalline structure.

When using a mono-functional monomer, a resin having a small molecular weight as a result of termination of the polymerization by the mono-functional monomer and a resin having a large molecular weight as a result of development of the polymerization by the mono-functional monomer are produced.

It is necessary that the resin having a small molecular weight has a similar structure to the resin having a large molecular weight.

Resultantly, this improves the compatibility of the resin having a small molecular weight and the resin having a large molecular weight, thereby reducing the occurrence of the damage during the transfer of the image in the paper path.

The ratio of the amount of melting heat of the component of the toner insoluble in a solvent mixture of tetrahydrofuran and ethyl acetate with a mass ratio of 1:1 in the second temperature rising to the amount of melting heat of the toner in the second temperature rising is from 0.2 to 1.25, preferably from 0.3 to 1.0, and more preferably from 0.4 to 0.8.

The volume average particle diameter of the toner is from 3 μm to 10 μm and preferably from 4 μm to 7 μm.

When the volume average particle diameter of the toner is too small, the fluidity and the transferability of the toner tend to deteriorate and when the volume average particle diameter is too large, the sharpness and fine-line reproducibility of an image may lose.

The volume average particle diameter of the toner can be measured by Coulter Counter method.

There is no specific limit to the method of manufacturing the toner.

Specific examples thereof include, but are not limited to, mixing, kneading, and pulverizing method and a chemical method manufacturing mother toner particles in an aqueous medium.

Of the two, the chemical method is more suitable.

A specific example of the mixing, kneading, and pulverizing method is to melting and mixing and kneading a toner composition containing a crystalline resin having a urethane bond and/or a urea bond in the main chain, a coloring agent, and organically modified laminate inorganic compound and pulverizing the kneaded mixture followed by classification of the pulverized resultant.

There is no specific limit to the melting and mixing and kneading machine.

Specific examples thereof include, but are not limited to, a single or twin screw continuous mixing kneader and a batch type mixing kneader by a roll mill.

Specific examples such mixing kneader include, but are not limited to, KTK type twin-screw extruders (manufactured by KOBE STEEL., LTD.), TEM type extruders (manufactured by TOSHIBA MACHINE CO., LTD.), twin-screw extruders (manufactured by KCK), PCM type twin-screw extruders (manufactured by IKEGAI CORP.), and Ko-kneaders (manufactured by Buss).

In the pulverization process, it is preferable to coarsely pulverize the kneaded mixture first followed by fine pulverization.

There is no specific limit to the method of pulverizing the kneaded mixture.

Specific examples thereof include, but are not limited to, a method in which the kneaded mixtures are pulverized by collision with a collision board in a jet stream, a method of collision between particles in a jet stream, and a method of pulverizing the kneaded mixture at narrow gaps between a stator and a rotor that is mechanically rotating.

The classification can be conducted using a cyclone, a decanter, a centrifugal, etc. to remove fine particles.

It is also possible to classify classified material in the air stream by centrifugal.

Specific examples of the chemical mal method includes: a solution suspension method of optionally dissolving and/or dispersing a toner composition containing a crystalline resin having a urethane bond and/or a urea bond in the main chain in an organic solvent followed by dispersion and/or emulsification in an aqueous medium; and a phase change emulsification method of dissolving and/or dispersing a toner composition containing a crystalline resin having a urethane bond and/or a urea bond in the main chain in an organic solvent followed by addition of water to change the phase.

Among these, the solution suspension method is preferable.

There is no specific limit to the organic solvent.

Specific examples thereof include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone.

These can be used alone or in combination.

Among these, ester-based solvents such as methyl acetate and ethyl acetate, aromatic based solvent such as toluene and xylene, and halogenized hydrocarbons such as methylene chloride, 1,2-dichloroethane, chloroform, and carbon tetrachloride are especially preferred.

The solid portion concentration in the liquid in which the toner composition is dissolved and/or dispersed in an organic solvent is preferably from 40% by weight to 80% by weight.

When preparing liquid in which the toner composition is dissolved and/or dispersed in an organic solvent, it is possible to dissolve and/or disperse each component of the toner composition or its master batch in an organic solvent.

Specific examples of the aqueous medium include, but are not limited to, water and a solvent mixture of water and a water-mixable solvent.

There is no specific limit to the solvents mixable with water.

Specific examples thereof include, but are not limited to, alcohols (e.g., methanol, isopropanol, and ethylene glycol), cellosolves (e.g., methyl cellosolve), ketones (e.g., acetone and methyl ethyl ketone), dimethylformamide, and tetrahydrofuran.

The weight ratio of the aqueous medium to the toner composition is from 0.50 to 20 and preferably from 1 to 10.

When the weight ratio of the aqueous medium to the toner composition is too small, the dispensability of the toner component tends to deteriorate.

A weight ratio of the aqueous medium to the toner composition that is too high is not economically preferable.

The aqueous medium may contain a surface active agent.

There is no specific limit to the selection of the surface active agent.

Specific examples of the surface active agents include, but are not limited to, anionic surface active agents such as alkylbenzene sulfonic acid salts, α-olefin sulfonic acid salts, and phosphoric esters; cationic surface active agents of amine salts (e.g., alkyl amine salts, aminoalcohol fatty acid derivatives, polyamine fatty acid derivatives and imidazoline); cationic surface active agents of quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surface active agents such as fatty acid amide derivatives, polyhydric alcohol derivatives; and ampholytic surface active agents such as alanine, dodecylbis(aminoethyl)glycin, bis(octylaminoethyle)glycin, and N-alkyl-N,N-dimethylammonium betaine.

Among these, surface active agents having fluoroalkyl groups are preferable.

Specific examples of the surface active agents having fluoroalkyl groups include, but are not limited to, anionic surface active agents having fluoroalkyl groups and cationic surface active agents having fluoroalkyl groups.

Specific examples of the anionic surface active agents having a fluoroalkyl group include, but are not limited to, fluoroalkyl carboxylic acids having from 2 to 10 carbon atoms and their metal salts, disodium perfluoro octane sulfonyl glutamate, sodium 3-{ω-fluoroalkyl(C6-C11)oxy}-1-alkyl (C3-C4) sulfonate, sodium 3-{ω-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10) sulfone amide propyl trimethyl ammonium salts, salts of perfluoroalkyl(C6-C10)-N-ethylsulfonyl glycin, monoperfluoroaklyl(C6-C16)ethylphosphates, etc.

Specific examples of the cationic surface active agents having a fluoroalkyl group include, but are not limited to, primary and secondary aliphatic amino acids, secondary amino acids, aliphatic quaternary ammonium salts (for example, perfluoroalkyl(C6-C10)sulfone amide propyl trimethyl ammonium salts), benzalkonium salts, benzetonium chloride, pyridinium salts, and imidazolinium salts.

The aqueous medium may contain an inorganic dispersant or resin particles.

There is no specific limit to the inorganic dispersant.

Specific examples thereof include, but are not limited to, tricalcium phosphate, calcium carbonate, titanium oxide, colloidal silica, and hydroxyapatite.

There is no specific limit to any resin dispersible in an aqueous medium.

Specific examples thereof include, but are not limited to, vinyl resins, polyurethane resins, epoxy resins, polyester resins, polyamide resins, polyimide resins, silicone resins, phenolic resins, melamine resins, urea resins, aniline resins, ionomer resins, and polycarbonate resins.

These can be used alone or in combination.

Among these resins, vinyl resins, polyurethane resins, epoxy resins, and polyester resins are preferably used.

There is no specific limit to the dispersion device for use in emulsifying or dispersing liquid in which the toner composition is dissolved and/or dispersed in an organic solvent in an organic solvent.

Specific examples of include, but are not limited to, a low speed shearing type dispersion device, a high speed shearing type dispersion device, a friction type dispersion device, a high pressure jet type dispersion device, and an ultrasonic dispersion device.

Among these, a high speed shearing type dispersion device is preferable.

When a high speed shearing type dispersion machine is used, the rotation speed is preferably from 1,000 to 30,000 rpm and more preferably from 5,000 rpm to 20,000 rpm.

The liquid in which the toner composition is dissolved and/or dispersed in an organic solvent is emulsified and/or dispersed in an aqueous medium at preferably from 0° C. to 150° C. (under pressure) and more preferably from 20° C. to 80° C.

When reacting a prepolymer having an isocyanate group at its end deriving from a crystalline polyurethane and a polyamine in the manufacturing process of toner, the polyamine may be contained in the toner composition or mixed in an aqueous medium when emulsifying and/or dispersing in the aqueous medium the liquid in which the toner composition is dissolved and/or dispersed in an organic solvent.

Mother toner particles are manufactured by removing the organic solvent from the liquid in which the liquid in which the toner composition is dissolved and/or dispersed in an organic solvent is emulsified and/or dispersed in the aqueous medium.

There is no specific limit to the removing method and any known method is suitable.

For example, it is possible to employ a method of gradually raising the temperature of the entire system at a normal or reduced pressure.

Instead of emulsifying and/or dispersing in an aqueous medium the liquid in which the toner composition is dissolved and/or dispersed in an organic solvent, it is possible to agglomerate particles after mixing the liquid in which the liquid in which each component of the toner composition or its master batch is dissolved and/or dispersed in an organic solvent is emulsified and/or dispersed in the aqueous medium.

Specific examples of the method of agglomerating particles include, but are not limited to, a heating method, a method of adding a metal salt, and a method of adjusting the pH.

There is no specific limit to the metal ions to constitute the metal salt.

Specific examples thereof include, but are not limited to, monovalent metal ions such as sodium ion and potassium ion; divalent metals such as calcium ion and magnesium ion; and trivalent metal such as aluminum ion.

Specific examples of anions that form the metal salts include, but are not limited to, chloride ion, bromide ion, iodine ion, carbonate ion, and sulfuric acid ion.

The metal salts are preferably magnesium chloride, aluminum chloride, and complexes and multimers thereof.

It is preferable to apply heat during or after agglomerating particles.

It is possible to promote adhesion of agglomerated particles.

Furthermore, it is possible to make a control to obtain sphere-like toner.

It is preferable to wash and dry the mother toner particle disperse in the aqueous medium.

When washing the mother toner particle, it is preferable to separate the solid portion from the liquid by a centrifugal or a filter press and repeat re-dispersing the solid portion in water at room temperature to about 40° C., optionally adjusting the pH by an acid or a base, and separating the solid portion from the liquid again several times.

As a result, impurities and surface active agents are removed.

It is possible to remove particulate components of the mother toner particle by centrifugal, etc. or dry the mother particle and thereafter optionally classify the mother toner particles by a known classifier.

There is no specific limit to the dryer for use in drying the mother toner particle. Specific examples thereof include, but are not limited to, an air stream drier, a circulation drier, a reduced-pressure drier, and a vibro-fluidizing drier.

It is suitable to mix the mother toner particle with foreign particles such as a charge control agent and a fluidity improver.

Optionally, it is possible to apply a mechanical impact during mixing.

Consequently, the foreign objects can be fixed onto the surface of the mother toner particle.

There is no specific limit to the method of applying the mechanical impact.

Specific examples thereof include, but are not limited to, methods in which an impact is applied to particles by using a blade rotating at a high speed, a method in which particles are put into a jet air to collide the particles against each other or into a collision plate.

There is no specific limit to such mechanical impact applicators.

Specific examples thereof include, but are not limited to, ONG MILL (manufactured by Hosokawa Micron Co., Ltd.), modified I TYPE MILL (manufactured by Nippon Pneumatic Mfg. Co., Ltd.) in which the pressure of pulverization air is reduced, HYBRIDIZATION SYSTEM (manufactured by Nara Machine Co., Ltd.), KRYPTON SYSTEM (manufactured by Kawasaki Heavy Industries, Ltd.), automatic mortars, etc.

The core material of the carrier is covered with a coating layer.

The coating layer contains a condensed compound of a melamine resin and/or a guanamine resin and an acrylic resin having a hydroxyl group.

This makes it possible to prevent detached organically modified laminate inorganic compound from the surface of the toner due to stirring stress in the development device from contaminating the surface of the carrier and consequently decreasing the size of charge.

At this point in time, the surface of the coating layer is gradually scraped off by friction between the carriers, so that the organically modified laminate inorganic compound attached to the surface of the carrier is scraped off.

There is no specific limit to the materials forming the core material.

Specific examples thereof include, but are not limited to, strong magnetizing materials having a mass susceptibility of from 75 emu/g to 120 emu/g such as magnetite, weak magnetizing materials having a mass susceptibility of from 30 emu/g to 80 emu/g such as copper-zinc (Cu—Zn) based materials, and magnetizing materials having a mass susceptibility of from 50 emu/g to 90 emu/g such as manganese-strontium (Mn—St) based materials and manganese-magnesium (Mn—Mg) based materials.

These can be used alone or in combination.

Among these, ferrite having a volume average particle diameter (D50) of from 20 μm to 70 μm is preferable.

The volume average particle diameter (D50) of the core material is from 20 μm to 70 μm and preferably from 40 μm to 70 μm. When the volume average particle diameter (D50) of the core material is too small, the carrier may scatter.

When the volume average particle diameter (D50) of the core material is too large, the toner may scatter.

There is no specific limit to the melamine resin.

Specific examples thereof include, but are not limited to, adducts or addition condensed compounds of melamine(1,3,5-triadine-2,4,6-triamine) with formaldehyde and alkoxyalkylized compounds thereof.

There is no specific limit to the guanamine resin.

Specific examples thereof include, but are not limited to, adducts or addition condensed compounds of guanamine (1,3,5-triadine-2,4-diamine), benzoguanamine, alkyl guanamine, etc. with formaldehyde and N-alkoxyalkylized compounds thereof.

There is no specific limit to the alkoxyalkyl group in the alkoxyalkylized compound. Specific examples thereof include, but are not limited to, methoxymethyl group, ethoxymethyl group, ethoxyethyl group, propoxymethyl group, propoxyethyl group, and butoxymethyl group.

These can be used alone or in combination.

Among these, N-alkoxyalkylized benzoguanamine resins are preferable and tetrabuthoxy methylized benzoguanamine are more preferable.

The polymerization degree of melamine resins or guanamine resins is normally 2 or less.

When the polymerization degree of melamine resins or guanamine resins is too high, the melamine resins or guanamine resins tend to be brittle.

The acrylic resin having a hydroxyl group is a monopolymer or copolymer of an acrylic monomer having a hydroxyl group.

The acrylic resin having a hydroxyl group can be condensed with a melamine resin and/or a guanamine resin because of the hydroxyl group.

There is no specific limit to the acrylic monomer having a hydroxyl group. Specific examples thereof include, but are not limited to, hydroxyethyl(meth)acrylate, hydroxypropyl (meth)acrylate, hydroxybutyl(meth)acrylate, 1,4-butanediol mono (meth)acrylate, adducts of hydroxyethyl(meth)acrylate with ϵ-caprolactone, and adducts of hydroxy ethyl (meth) acrylate with ethylene or propylene.

There is no specific limit to the monomer copolymerizable with the acrylic monomer having a hydroxyl group.

Specific examples thereof include, but are not limited to, (meth)crylic acid esters such as methyl (meth)acrylate, ethyl (meth)acrylate, propyl(meth)acrylate, n-butyl (meth)acrylate, isobutyl(meth)acrylate, tert-butyl (meth)acrylate, 2-ethylhexyl(meth)acrylate, stearyl(meth)acrylate, tridecyl(meth) acrylate, cyclohexyl(meth)acrylate, phenyl(meth)acrylate, dimethyl aminoethyl(meth)acrylate, styrene, α-methylstyrene, vinyl toluene, acrylonitril, vinyl acetate, vinyl propionate, (meth)acrylamide, methylol acryl amide, vinyl chloride, propylene, and ethylene.

The acrylic resin having a hydroxyl group preferably has a hydroxyl value of from 20 KOHmg/g to 150 KOHmg/g and more preferably from 40 KOHmg/g to 120 KOHmg/g.

When the hydroxyl value of the acrylic resin having a hydroxyl group is too low, the strength of the coating layer tends to deteriorate.

When the hydroxyl value of the acrylic resin having a hydroxyl group is too high, the charging stability of the carrier may deteriorate.

It is more preferable that the coating layer contains inorganic oxide particles.

As a result, the strength of the coating layer is improved.

There is no specific limit to the inorganic oxide particles.

Specific examples thereof include, but are not limited to, silica particles, alumina particles, titanium oxide particles, iron oxide particles, copper oxide particles, zinc oxide particles, tin oxide particles, chromium oxide particles, cerium oxide particles, magnesium oxide particles, and zirconium antimony oxide particles.

These can be used alone or in combination.

Among these, alumina particles are preferable because they are excellent about the holding property of the charge generated at the carrier.

It is also suitable to use a surface-treated (such as hydrophobized) inorganic oxide particles.

The content of the inorganic oxide particles in the coating layer is from 2% by weight to 40% by weight and preferably from 5% by weight to 20% by weight.

When the content of the inorganic oxide particles in the coating layer is too small, the strength of the coating layer tends to deteriorate.

By contrast, when the content is too large, the organically modified laminate inorganic compound may contaminate the surface of the carrier.

Furthermore, the coating layer may contain electroconductive particles.

There is no specific limit to such electroconductive particles.

Specific examples thereof include, but are not limited to, metal particles, carbon blacks, titanium oxide particles, tin oxide particles, and zinc oxide particles.

Among these, carbon black is preferable.

The electroconductive particle has an average particle diameter of 1 μm or less.

When the average particle diameter is too large, controlling the electric resistance of the coating layer may become difficult.

The coating layer is formed by applying a liquid application of coating layer containing a melamine resin and/or a guanamine resin, an acrylic resin having a hydroxyl group, and an organic solvent to the surface of the core material followed by drying and baking.

There is no specific limit to the organic solvent.

Specific examples thereof include, but are not limited to, toluene, xylene, methylethyl ketone, methylisobutyl ketone, cellosolve, and butylacetate.

There is no specific limit to the method of applying the liquid application of coating layer. For example, a brushing method, a spraying method, or a dipping method can be used.

The heater for use in baking may employ an external heating system or an internal heating system.

There is no specific limit to the heater.

Specific examples thereof include, but are not limited to, a fixed furnace, fluidizing electric furnace, a rotary furnace, a burner furnace, and a microwave heater.

The content of the coating layer in the carrier is from 0.01% by weight to 5.0% by weight.

The image forming apparatus includes an image bearing member, a charger, an irradiator, a development device, a transfer device, a stabilizer, and other optional devices such as a cleaner, a discharger, and a recycling device.

There is no specific limit to the form of the image bearing member.

There a drum-like image bearing member, a sheet-like image bearing member, and an endless belt-like image bearing member.

The image bearing member may have a single-layered structure or a laminate structure.

There is no specific limit to the materials that form the image bearing member.

Specific examples thereof include, but are not limited to, inorganic materials such as amorphous silicon, selenium, cadmium sulfide, and zinc oxide; and organic materials such as polysilane and phthalopolymethine.

There is no specific limit to the charger that can apply a voltage to the surface of the image bearing member to uniformly charge it.

These are generally classified into: a contact type charger that charges the image bearing member by contact; and a non-contact type charger that charges the image bearing member in a non-contact manner.

Specific examples of the contact-type charger include, but are not limited to, an electroconductive or semi-electroconductive charging roller, a magnetic brush, a fur brush, a film, and a rubber blade.

Specific examples of the non-contact-type charger include, but are not limited to, a non-contact type charger, a needle electrode device, and a solid discharging element, which use corona discharging; and an electroconductive or semi-electroconductive charging roller arranged against the image bearing member with a minute gap therebetween.

There is no specific limit to the irradiator as long as it can irradiate the surface of the image bearing member based on the acquired image data.

Specific examples thereof include, but are not limited to, a photocopying optical system, a rod lens array system, a laser optical system, a liquid crystal shutter optical system, and an LED optical system.

The irradiator may employ a rear-irradiating optical system that irradiates the surface of the image bearing member from the rear side thereof based on the acquired image data.

There is no specific limit to the development device as long as it can develop a latent electrostatic image formed on the surface of the image bearing member with the development agent described above.

A specific example thereof is a development device that can accommodate the development agent and provide the development agent to the latent electrostatic image in a contact or non-contact manner.

A single-color development device and a multi-color development device are both suitable.

It is preferable that the development device has a stirrer to triboelectrically charge the development agent by frictional stirring and a magnet roller rotatable while bearing the development agent on its surface.

In the development device, toner and carrier are mixed and stirred to triboelectrically charge the toner.

The charged toner is held in a filament manner on the surface of the magnet roller in rotation to form a magnet brush. Since the magnet roller is provided in the vicinity of the image bearing member, part of the toner forming the magnet brush borne on the surface of the magnet roller is transferred to the surface of the image bearing member by electric attraction force.

As a result, the latent electrostatic image is developed with the toner to form a visual toner image on the surface of the image bearing member.

Figure 2:
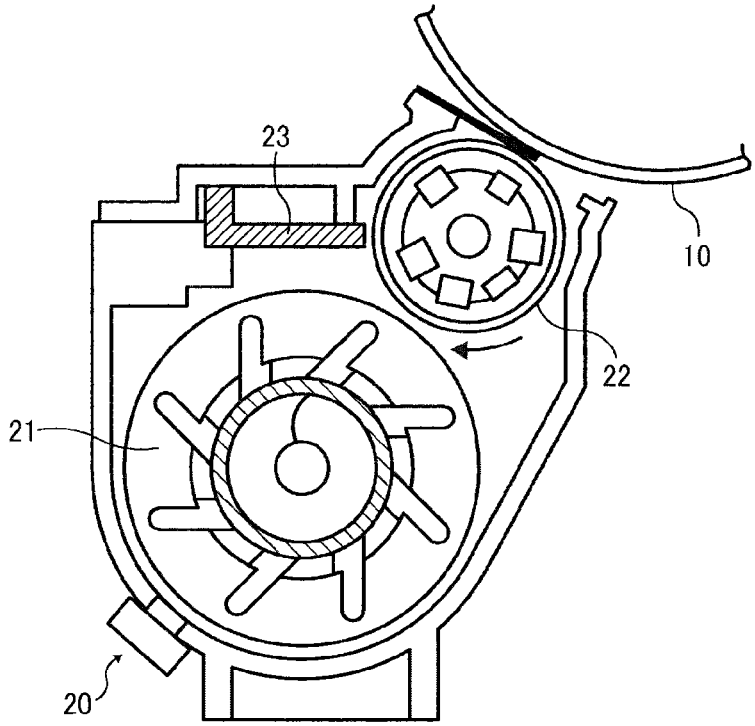
FIG. 2 is a schematic diagram illustrating an example of the configuration of a development device of the present disclosure.

FIG. 2 is a diagram illustrating an example of the development device.

In a development device 20, the development agent is stirred and transferred by a screw 21 and supplied to a development sleeve 22.

The thickness of the development agent supplied to the development sleeve 22 is regulated by a doctor blade 23.

The content of the development agent supplied to the development sleeve 22 is controlled by a doctor gap between the development sleeve 22 and the doctor blade 23. When the doctor gap is too narrow, the content of the development agent supplied to the development sleeve 22 tends to be excessively small, thereby reducing the image density.

When the doctor gap is too wide, the content of the development agent supplied to the development sleeve 22 tends to be excessively large, so that the carrier adheres to an image bearing member 10 having a drum-like form.

Inside the development sleeve 22, a magnet is provided to generate a magnetic field to hold the development agent forming filaments on the circumference surface of the development sleeve 22, so that the magnetic brush is formed like a chain filament on the development sleeve 22 along the magnetic line in the normal line direction generated by the magnet.

The development sleeve 22 and the image bearing 10 are arranged in the vicinity of each other with a constant gap (development gap) to form development areas on both opposing portions.

The development sleeve 22 has a cylindrical form made of non-magnetic substance such as aluminum, brass, stainless steel, and electroconductive resin and can rotate by a rotation driving mechanism.

The magnetic brush is transferred to the development area by the rotation of the development sleeve 22.

A development bias is applied to the development sleeve 22 by a power source for development so that the toner on the magnet brush is detached from the carrier by the development electric field formed between the development sleeve 22 and the image bearing member 10 to develop the latent electrostatic image on the surface of the image bearing drum 10.

An AC voltage can be superimposed on the development voltage.

The development gap is preferably about 5 times to about 30 times as large as the particle diameter of the development agent.

When the development gap is too large, the image density may decrease.

In addition, the doctor gap is preferably the same as the development gap or slightly larger than that.

The ratio of the linear speed of the development sleeve 22 to the linear speed of the image bearing member 10 is preferably 11 or greater. When the ratio of the linear speed of the development sleeve 22 to the linear speed of the image bearing member 10 is too small, the image density may decrease.

It is also possible to provide a sensor at the position of the image bearing member 10 after development to detect the attachment amount of the toner from the optical reflectivity, thereby making it possible to control the process conditions.

Specific examples of the transfer device include, but are not limited to, a transfer device that directly transfers a toner image formed on the surface of the image bearing member to a recording medium and a transfer device that primarily transfers a toner image formed on the surface of the image bearing member to an intermediate transfer element and thereafter secondarily transfers the toner image to a recording medium.

There is no specific limit to the fixing device as long as it can fix the toner image transferred to the recording medium.

A specific example of the fixing device includes a fixing member and a heat source to heat the fixing member.

There is no specific limit to the fixing member as long as it can form a nipping portion by contacting each other.

Specific examples thereof include, but are not limited to, a combination of an endless belt and a roller and a combination of a roller and roller.

To be specific, the fixing device may employ an internal heating system having a roller and/or a belt to heat or press the toner image transferred to a recording medium by heating the toner image from the side not in contact with the toner image or an external heating system having a roller and/or a belt to heat or press the toner image transferred to a recording medium by heating the toner image from the side in contact with the toner image.

It is suitable to use the internal heating system and the external system in combination.

A specific example of the internal heating system includes a fixing member having a heat source inside thereof.

There is no specific limit to the heating source.

Specific examples thereof include, but are not limited to, a heater and a halogen lamp.

A specific example of the external heating system includes a fixing member whose surface is heated by a heating device.

There is no specific limit to the heating device.

A specific example thereof is an electromagnetic induction heating device.

A specific example of the electromagnetic induction heating device includes an induction coil arranged close to the fixing member (for example, a heating roller), a shielding layer to which the induction coil is provided, and an insulation layer provided to the induction coil with the shielding layer therebetween.

There is no specific limit to the heating roller.

Specific examples thereof include, but are not limited to, a roller made of a magnetic substance and a roller made of a heat pipe.

It is preferable that the induction coil is arranged on the reverse side of the area contacting the fixing member such as the pressing roller of a heating roller and an endless belt in such a manner to enfold the semi-circular portion.

There is no specific limit to the recording medium, typically paper is used.

There is no specific limit to the image forming apparatus.

Specific examples thereof include, but are not limited to, a facsimile machine and a printer.

The process cartridge, which is detachably attachable to an image forming apparatus, includes an image bearing member, a development device, and other optional devices such as a charger, an irradiator, a transfer device, a cleaner, and a discharger.

Figure 3:
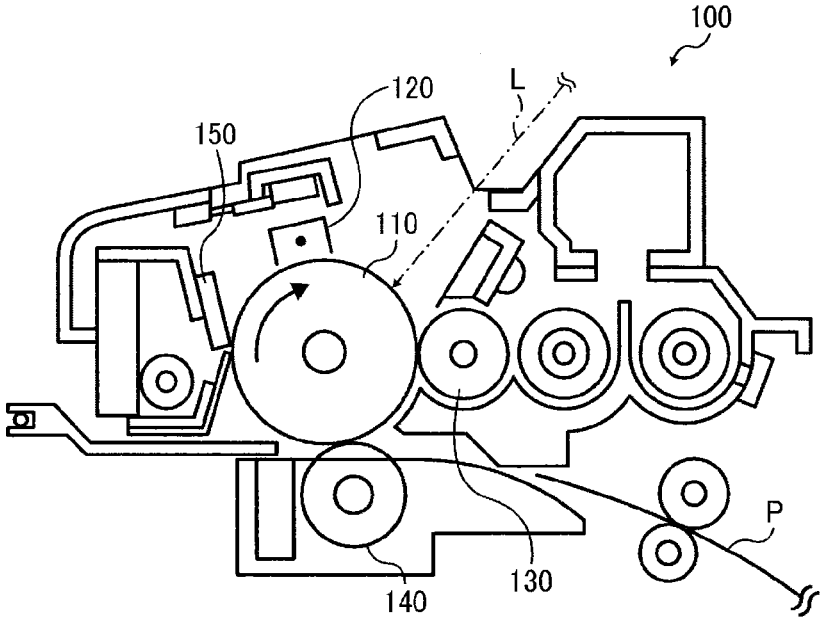
FIG. 3 is a schematic diagram illustrating an example of a process cartridge of the present disclosure.

FIG. 3 is a diagram illustrating an example of the process cartridge.

A process cartridge 100 includes an image bearing member 110 having a drum form, a charger 120, a development device 130, a transfer device 140, and a cleaner 150.

Next, the image forming process by the process cartridge 100 is described next.

The image bearing member 110 is charged by the charger 120 and irradiated with a beam L by an irradiator while rotating in the direction indicated by the arrow in FIG. 3 to form a latent electrostatic image based on image data corresponding to irradiation beams of light 103.

The latent electrostatic image formed on the image bearing member 110 is developed with the development agent described above by the development device 130 to form a toner image followed by transfer of the toner image to a recording medium P by the transfer device 105 and thereafter printed out.

Residual toner remaining on the surface of the image bearing member 110 from which the toner image has been transferred is removed by the cleaner 150.

Having generally described preferred embodiments, further understanding can be obtained by reference to certain specific examples which are provided herein for the purpose of illustration only and are not intended to be limiting.

In the descriptions in the following examples, the numbers represent weight ratios in parts, unless otherwise specified.

EXAMPLES

Next, the present disclosure is described in detail with reference to Examples but not limited thereto.

Manufacturing of Crystalline Polyurethane Resin 1

Place 303 parts of sebacic acid, 121 parts of ethylene glycol, and 1 part of titanium dihydroroxybis(triethanol aminate) as a condensing catalyst in a reaction container equipped with a condenser, a stirrer, and a nitrogen introducing tube to conduct reaction for eight hours at 180° C. in a nitrogen atmosphere while distilling away produced water.

Next, conduct reaction for four hours while gradually heating the system to 220° C. and distilling away produced water and ethylene glycol in a nitrogen atmosphere and continue the reaction with a reduced pressure of from 5 mmHg to 20 mmHg until the weight average molecular weight reaches 7,500 to obtain polyester diol.

Add 450 parts of ethyl acetate to dissolve polyester diol and add 22 parts of 4,4'-diphienyl methane diisocyanate (MDI) to conduct reaction in a nitrogen atmosphere at 80° C. for 5 hours. Next, distill away ethyl acetate under a reduced pressure to obtain Crystalline Polyurethane 1 having a weight average molecular weight of 23,000, a maximum endothermic peak in the second temperature rising of 68° C., and a softening point of 74° C.

Manufacturing of Crystalline Polyurethane Resin 2

Place 303 parts of sebacic acid, 230 parts of 1,6-hexane diol, and 1 part of titanium dihydroroxybis(triethanol aminate) as a condensing catalyst in a reaction container equipped with a condenser, a stirrer, and a nitrogen introducing tube to conduct reaction for eight hours at 180° C. in a nitrogen atmosphere while distilling away produced water.

Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until the weight average molecular weight reaches 8,000 to obtain polyester diol.

Add 550 parts of ethyl acetate to dissolve polyester diol and add 25 parts of 4,4'-diphienyl methane diisocyanate (MDI) to conduct reaction in a nitrogen atmosphere at 80° C. for 5 hours.

Next, distill away ethyl acetate under a reduced pressure to obtain Crystalline Polyurethane 2 having a weight average molecular weight of 24,500, a maximum endothermic peak in the second temperature rising of 65° C., and a softening point of 67° C.

Manufacturing of Crystalline Polyurethane Resin 3

Place 303 parts of sebacic acid, 121 parts of ethylene glycol, and 1 part of titanium dihydroroxybis(triethanol aminate) as a condensing catalyst in a reaction container equipped with a condenser, a stirrer, and a nitrogen introducing tube to conduct reaction for eight hours at 180° C. in a nitrogen atmosphere while distilling away produced water.

Next, conduct reaction for four hours while gradually heating the system to 220° C. and distilling away produced water and ethylene glycol in a nitrogen atmosphere and continue the reaction with a reduced pressure of from 5 mmHg to 20 mmHg until the weight average molecular weight reaches 6,400 to obtain polyester diol.

Add 450 parts of ethyl acetate to dissolve polyester diol, add 47 parts of an adduct of bisphenol A with 2 mol of propylene oxide, 29 parts of an adduct of bisphenol A with 2 mols of ethylene oxide, and 94 parts of 4,4'-diphienyl methane diisocyanate (MDI) to conduct reaction in a nitrogen atmosphere at 80° C. for 5 hours.

Next, distill away ethyl acetate under a reduced pressure to obtain Crystalline Polyurethane 3 having a weight average molecular weight of 23,200, a maximum endothermic peak in the second temperature rising of 63° C., and a softening point of 82° C.

Manufacturing of Crystalline Polyurethane Resin 4

Place 303 parts of sebacic acid, 230 parts of 1,6-hexane diol, and 1 part of titanium dihydroroxybis(triethanol aminate) as a condensing catalyst in a reaction container equipped with a condenser, a stirrer, and a nitrogen introducing tube to conduct reaction for eight hours at 180° C. in a nitrogen atmosphere while distilling away produced water. Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until the weight average molecular weight reaches 6,800 to obtain polyester diol. Add 550 parts of ethyl acetate to dissolve polyester diol, add 59 parts of an adduct of bisphenol A with 2 mols of propylene oxide, 36 parts of an adduct of bisphenol A with 2 mols of ethylene oxide, and 119 parts of 4,4'-diphienyl methane diisocyanate (MDI) to conduct reaction in a nitrogen atmosphere at 80° C. for 5 hours.

Next, distill away ethyl acetate under a reduced pressure to obtain Crystalline Polyurethane 4 having a weight average molecular weight of 24,400, a maximum endothermic peak in the second temperature rising of 61° C., and a softening point of 80° C.

Manufacturing of Crystalline Polyurethane Resin 5

Place 303 parts of sebacic acid, 230 parts of 1,6-hexane diol, and 1 part of titanium dihydroroxybis(triethanol aminate) as a condensing catalyst in a reaction container equipped with a condenser, a stirrer, and a nitrogen introducing tube to conduct reaction for eight hours at 180° C. in a nitrogen atmosphere while distilling away produced water.

Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until the weight average molecular weight reaches 6,800 to obtain polyester diol. Add 550 parts of ethyl acetate to dissolve polyester diol, add 147 parts of an adduct of bisphenol A with 2 mols of propylene oxide, 90 parts of an adduct of bisphenol A with 2 mols of ethylene oxide, and 245 parts of 4,4'-diphienyl methane diisocyanate (MDI) to conduct reaction in a nitrogen atmosphere at 80° C. for 5 hours.

Next, distill away ethyl acetate under a reduced pressure to obtain Crystalline Polyurethane 5 having a weight average molecular weight of 19,700, a maximum endothermic peak in the second temperature rising of 55° C., and a softening point of 82° C.

Manufacturing of Crystalline Polyurethane Resin 6

Place 303 parts of sebacic acid, 230 parts of 1,6-hexane diol, and 1 part of titanium dihydroroxybis(triethanol aminate) as a condensing catalyst in a reaction container equipped with a condenser, a stirrer, and a nitrogen introducing tube to conduct reaction for eight hours at 180° C. in a nitrogen atmosphere while distilling away produced water.

Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until the weight average molecular weight reaches 6,000 to obtain polyester diol.

Add 550 parts of ethyl acetate to dissolve polyester diol, add 189 parts of an adduct of bisphenol A with 2 mol of propylene oxide, 116 parts of an adduct of bisphenol A with 2 mols of ethylene oxide, and 310 parts of 4,4'-diphienyl methane diisocyanate (MDI) to conduct reaction in a nitrogen atmosphere at 80° C. for 5 hours. Next, distill away ethyl acetate under a reduced pressure to obtain Crystalline Polyurethane 6 having a weight average molecular weight of 19,300, a maximum endothermic peak in the second temperature rising of 55° C., and a softening point of 84° C.

Manufacturing of Crystalline Polyurethane Resin 7

Place 135 parts of 1,4-butane diol, 177 parts of 1,6-hexane diol, 400 parts of methylethylketone, and 485 parts of hexamethylene diisocyanate (HDI) in a reaction container equipped with a condenser, a stirrer, and a nitrogen introducing tube to conduct reaction at 80° C. in a nitrogen atmosphere for eight hours.

Next, distill away methyl ethyl ketone under a reduced pressure to obtain Crystalline Polyurethane 7 having a weight average molecular weight of 16,000, a maximum endothermic peak in the second temperature rising of 65° C., and a softening point of 103° C.

Manufacturing of Crystalline Polyurethane Resin 8

Place 303 parts of sebacic acid, 230 parts of 1,6-hexane diol, and 1 part of titanium dihydroroxybis(triethanol aminate) as a condensing catalyst in a reaction container equipped with a condenser, a stirrer, and a nitrogen introducing tube to conduct reaction for eight hours at 180° C. in a nitrogen atmosphere while distilling away produced water.

Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until the weight average molecular weight reaches 6,800 to obtain polyester diol.

Add 600 parts of methylethyl ketone to dissolve polyester diol to obtain a polyester diol solution.

Place 119 parts of 4,4'-diphenyl methane diisocyanate (MDI), 300 parts of methylethyl ketone, 59 parts of an adduct of bisphenol A with 2 mols of propylene oxide, and 36 parts of an adduct of bisphenol A with 2 mols of ethylene oxide to conduct reaction at 80° C. in a nitrogen atmosphere to obtain a polyurethane diisocyanate solution.

Add the polyurethane diisocyanate solution to the polyester diol solution to conduct reaction at 80° C. in a nitrogen atmosphere for eight hours and thereafter distill away methyl ethyl ketone under a reduced pressure to obtain Crystalline Polyurethane 8 having a weight average molecular weight of 24,400, a maximum endothermic peak in the second temperature rising of 59° C., and a softening point of 86° C.

Manufacturing of Crystalline Polyurethane Resin 9

Place 303 parts of sebacic acid, 230 parts of 1,6-hexane diol, and 1 part of titanium dihydroroxybis(triethanol aminate) as a condensing catalyst in a reaction container equipped with a condenser, a stirrer, and a nitrogen introducing tube to conduct reaction for eight hours at 180° C. in a nitrogen atmosphere while distilling away produced water.

Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until the weight average molecular weight reaches 145,000 to obtain polyester diol.

Add 550 parts of ethyl acetate to dissolve polyester diol and add 22 parts of 4,4'-diphienyl methane diisocyanate (MDI) to conduct reaction in a nitrogen atmosphere at 80° C. for 5 hours.

Next, distill away ethyl acetate under a reduced pressure to obtain Crystalline Polyurethane 9 having a weight average molecular weight of 73,500, a maximum endothermic peak in the second temperature rising of 68° C., and a softening point of 69° C.

Manufacturing of Polyurethane Prepolymer 1

Place 303 parts of sebacic acid, 230 parts of 1,6-hexane diol, and 1 part of titanium dihydroroxybis(triethanol aminate) as a condensing catalyst in a reaction container equipped with a condenser, a stirrer, and a nitrogen introducing tube to conduct reaction for eight hours at 180° C. in a nitrogen atmosphere while distilling away produced water.

Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until the weight average molecular weight reaches 8,500 to obtain polyester diol. Add 550 parts of ethyl acetate to dissolve polyester diol, add 23 parts of an adduct of bisphenol A with 2 mol of propylene oxide, 14 parts of an adduct of bisphenol A with 2 mots of ethylene oxide, and 53 parts of 4,4'-diphienyl methane diisocyanate (MDI) to conduct reaction in a nitrogen atmosphere at 80° C. for 5 hours.

Next, distill away ethyl acetate under a reduced pressure to obtain Crystalline Polyurethane 10 having a weight average molecular weight of 18,400, a maximum endothermic peak in the second temperature rising of 60° C., and a softening point of 80° C. Add 550 parts of ethyl acetate to dissolve Crystalline Polyurethane 10 and add 36 parts of 4,4'-diphienyl methane diisocyanate (MDI) to conduct reaction in a nitrogen atmosphere at 80° C. for 5 hours.

Thereafter, adjust the solid portion concentration by adding ethyl acetate to obtain 50% by weight ethyl acetate solution of Polyurethane Prepolymer 1 having an isocyanate group at its end.

Manufacturing of Crystalline Polyester 1

Place 303 parts of sebacic acid, 230 parts of 1,6-hexane diol, and 1 part of titanium dihydroroxybis(triethanol aminate) as a condensing catalyst in a reaction container equipped with a condenser, a stirrer, and a nitrogen introducing tube to conduct reaction for eight hours at 180° C. in a nitrogen atmosphere while distilling away produced water.

Next, conduct reaction for four hours while gradually heating the system to 220° C. and distilling away produced water and 1,6-hexane diol in a nitrogen atmosphere and continue the reaction for six hours with a reduced pressure of from 5 mmHg to 20 mmHg to obtain Crystalline Polyester 1 having a weight average molecular weight of 18,000, a maximum endothermic peak in the second temperature rising of 67° C., and a softening point of 65° C.

Manufacturing of Non-Crystalline Polyester 1

Place 148 parts of 1,2-propane diol, 237 parts of terephthalic acid, and 0.6 parts of tetrabuthoxy titanate as a condensing catalyst in a reaction container equipped with a condenser, a stirrer, and a nitrogen introducing tube to conduct reaction at 180° C. in a nitrogen atmosphere for eight hours while distilling away produced water.

Next, conduct reaction for four hours while gradually heating the system to 230° C. and distilling away produced water and 1,2-propane diol in a nitrogen atmosphere, continue the reaction for one hour with a reduced pressure of from 5 mmHg to 20 mmHg, and cool down the system to 180° C.

Add 14 parts of trimellitic anhydride and 0.5 parts of tetrabuthoxy titanate, continue the reaction for one more hour, and thereafter conduct reaction under a reduced pressure of from 5 mmHg to 20 mmHg to obtain Non-Crystalline Polyester 1 having a weight average molecular weight of 23,000, a maximum endothermic peak in the second temperature rising of 58° C., and a softening point of 105° C.

The properties of the crystalline polyesters are shown in Table 1.

TABLE 1

| | Cryatalline Polyurethane | | | | | | | | | |
|---|---|---|---|---|---|---|---|---|---|---|
| | 1 | 2 | 3 | 4 | 5 | 6 | 7 | 8 | 9 | 10 |
| Td (° C.) | 68 | 65 | 63 | 61 | 55 | 55 | 65 | 59 | 68 | 60 |
| Tf (° C.) | 74 | 67 | 82 | 80 | 82 | 84 | 103 | 86 | 69 | 80 |
| Tf/Td | 1.09 | 1.03 | 1.30 | 1.31 | 1.49 | 1.53 | 1.58 | 1.46 | 1.01 | 1.33 |

Maximum Endothermic Peak Temperature Td in Second Temperature Rising and Maximum Exothermic Peak Temperature Td' in First Temperature Descending Using a differential scanning calorimeter (DSC) (TA-60WS and DSC-60, manufactured by Shimadzu Corporation), measure the maximum endothermic peak temperature in the second temperature rising.

To be specific, place 5 mg of sample (i.e., toner and resin) in an aluminum sample pan and set it in the device. As a reference, use 10 mg of alumina and place it in an aluminum sample pan in the same manner as the sample.

Next, raise the temperature from 20° C. to 100° C. at a temperature rising speed of 10° C./min. (first temperature rising), cool down the system to 0° C. at a temperature descending speed of 10° C./min. (first temperature descending) and determine the exothermic peak temperature at which the amount of generated heat is the maximum as the maximum exothermic peak temperature Td'.

Thereafter, raise the temperature to 100° C. at a temperature rising speed of 10° C./min. (second temperature rising) and determine the endothermic peak temperature at which the amount of absorbed heat is the maximum as the maximum endothermic peak temperature Td.

The measuring results are analyzed by using data analysis software (TA-60, version 1.52, manufactured by Shimadzu Corporation).

Softening Point Tf

Measure the softening point using a flow tester (CFT-500D, manufactured by Shimadzu Corporation).

Apply a load of 2.94 MPa to one gram of a sample by a plunger while heating the sample at a temperature rising speed of 3° C./min. to extrude it from a nozzle having a diameter of 0.5 mm and a length of 1 mm; Plot the plunger descending amount of the flow tester against the temperature.

Determine the temperature at which a half of the sample has flown out as the softening temperature Tf.

Weight Average Molecular Weight

Measure the weight average molecular weight using a high speed GPC HLC-8220 GPC (manufactured by TOSOH CORPORATION).

The column used is TSK gel Super HZM-M 15 cm triplet (manufactured by TOSOH CORPORATION). Dissolve the sample in tetrahydrofuran (WAKO PURE CHEMICAL INDUSTRIES, LTD.) containing a stabilizer to obtain a 0.15% by weight solution followed by filtration with a filter having an opening diameter of 0.2 μm and infuse 100 μl of the TRF sample solution into the measuring instrument.

Measure the weight average molecular weight at a flowing speed of 0.35 mL/minute at 40° C.

The molecular weight of the sample is calculated by using the relation between the logarithmic values and the number of counts of the standard curve made by a mono-dispersed polystyrene standard sample (manufactured by Showdex STANDARD SERIES (manufactured by SHOWA DENKO K.K.) and toluene.

To be specific, when obtaining a standard curve, solutions A, B, and C of the standard sample are used and the maintaining time of the peak top is determined as the molecular weight in polystyrene conversion.

A refractive index (RI) detector is used in the measurement.

Solution A:

S-7450: 2.5 mg; S-678: 2.5 mg, S-46.5: 2.5 mg, S-2.90: 2.5 mm, THF: 50 ml

Solution B:

S-3730: 2.5 mg, S-257: 2.5 mg, S-19.8: 2.5 mg, S-0.580: 2.5 mm, THF: 50 ml

Solution C:

S-1470: 2.5 mg, S-112: 2.5 mg, S-6.93: 2.5 mg, Toluene: 2.5 mg, THF: 50 ml.

EXAMPLE 1

Manufacturing of Toner 1

Mix 100 parts of Crystalline Polyurethane 1, 100 parts of cyan pigment (C.I. Pigment Blue 15: 3), and 30 parts of deionized water followed by mixing and kneading by an open roll type kneader (KNEADEX, manufactured by NIPPON COKE & ENGINEERING. CO., LTD.) to obtain a master batch of pigment.

To be specific, start mixing and kneading the mixture at 90° C. and cool it down gradually to 50° C.

Mix 100 parts of Crystalline Polyurethane 1, 100 parts of montmorillonite (CLAYTON APA, manufactured by SOUTHERN CLAY PRODUCTS INCORPORATE) in which quaternary ammonium ions having a benzyl group are at least partially substituted for cations present between layers, and 50 parts of deionized water followed by mixing and kneading by an open roll type kneader (KNEADEX, manufactured by NIPPON COKE & ENGINEERING. CO., LTD.) to obtain a master batch of a laminate inorganic compound.

To be specific, start mixing and kneading the mixture at 90° C. and cool it down gradually to 50° C.

Place 20 parts of paraffin wax (HNP-9, melting point: 75° C., manufactured by NIPPON SEIRO CO., LTD.) and 80 parts of ethyl acetate in a reaction container equipped with a condenser, a thermometer, and a stirrer, heat the system to 78° C. to melt the wax; and cool it down to 30° C. in one hour while stirring.

Thereafter, wet-pulverize the resultant under the conditions of: liquid transfer speed 1.0 kg/h; disk circumferential speed: 10 m/s; filling ratio of 0.5 mm zirconia beads: 80% by volume; number of passes: 6. by using ULTRAVISCOMILL from AIMEX.

Adjust the solid portion concentration by adding ethyl acetate to obtain a liquid dispersion of wax having a solid portion concentration of 20% by weight.

Place 94 parts of Crystalline Polyurethane 1 and 91 parts of ethyl acetate in a container equipped with a thermometer and a stirrer and raise the temperature to the maximum endothermic peak temperature in the second temperature rising of Crystalline Polyurethane 1 or higher to dissolve it.

Next, add 25 parts of the liquid dispersion of wax, 2 parts of the master batch of the laminate inorganic compound, and 10 parts of the master batch of the pigment and thereafter conduct stirring at 10,000 rpm by a TK type HOMOMIXER (manufactured by TOKUSHU KIKA KOGYO CO., LTD.) at 50° C. to obtain a wax phase.

Place 75 parts of deionized water, 20 parts of 10% by weight lauryl sodium sulfate aqueous solution, 5 parts of 10% by weight sodium chloride aqueous solution, and 10 parts of ethyl acetate in a container equipped with a thermometer and a stirrer followed by stirring at 40° C. to obtain an aqueous phase.

Add 50 parts of the oil phase held at 50° C. followed by stirring at 12,000 rpm for 1 minute by a TK HOMOMIXER (manufactured by PRIMIX CORPORATION) to obtain an emulsified slurry.

Place the emulsified slurry in a container equipped with a thermometer and a stirrer followed by removal of solvent for 2 hours at 60° C. to obtain a slurry dispersion.

Filter 100 parts of the slurry dispersion with a reduced pressure to obtain a filtered cake.

Add 100 parts of deionized water to the filtered cake and conduct stirring at 6,000 rpm for 5 minutes by a TK HOMOMIXER (TOKUSHU KIKA KOGYO CO., LTD.) followed by filtration.

Add 100 parts of 10% by weight sodium hydroxide aqueous solution to the filtered cake and conduct stirring at 6,000 rpm for 10 minutes by a TK HOMOMIXER (manufactured by TOKUSHU KIKA KOGYO CO., LTD.) followed by filtration with a reduced pressure. Add 100 parts of 10% by weight hydrochloric acid to the filtered cake and conduct stirring at 6,000 rpm for 5 minutes by a TK HOMOMIXER (manufactured by TOKUSHU KIKA KOGYO CO., LTD.) followed by filtration Add 300 parts of deionized water to the filtered cake followed by stirring by TK HOMOMIXER at 6,000 rpm for 5 minutes followed by filtration.

This operation is repeated twice to obtain a filtered cake.

Dry the obtained filtered cake by a circulation drier at 45° C. for 48 hours followed by screening with a mesh having an opening of 75 μm to obtain mother particles.

Mix 100 parts of the mother toner particle and 1.0 part of hydrophobic silica (HDK-2000, manufactured by WACKER-CHEMIE GMBH) by using a HENSCHEL MIXER to obtain Toner 1 having a volume average particle diameter of 5.2 μm.

Manufacturing of Carrier 1

Stir 300 parts of toluene, 300 parts of butyl cellosolve, 60 parts of 50% by weight toluene solution of an acrylic resin having a the glass transition temperature of 38° C., 15 parts of 77% by weight toluene solution of an N-tetra methoxy methyl benzoguanamine resin having a polymerization degree of 1.5, and 15 parts of alumina particles having an average primary particle diameter of 0.30 μm with a stirrer for 10 minutes to obtain a liquid application of coating layer.

The acrylic resin has a monomer composition of methacrylic acid:methyl methacrylate: 2-hydroxyethyl acrylate=5:9:3.

Place 5,000 parts of Mn-ferrite particles having a volume average particle diameter (D50) of 35 μm in an applicator having a rotatable base disk and a stirring wing in the fluidizing bed to form a swirl flow, apply the liquid application of coating layer to the particles, and bake them at 220° C. for 2 hours using an electric furnace to obtain Carrier 1.

Manufacturing of Development Agent 1

Using a tubular mixer (manufactured by WACKER-CHEMIE GMBH) which stirs by tumbling the container, stir 100 parts of Carrier 1 and 7 parts of Toner 1 at 48 rpm for 5 minutes for charging.

EXAMPLE 2

Manufacturing of Toner 2

Toner 2 having a volume average particle diameter of 5.2 μm is manufactured in the same manner as in Toner 1 except that Crystalline Polyurethane 2 is used instead of Crystalline Polyurethane 1.

Manufacturing of Development Agent 2

Development Agent 2 is manufactured in the same manner as Toner 1 except that Toner 2 is used instead of Toner 1.

EXAMPLE 3

Manufacturing of Toner 3

Toner 3 having a volume average particle diameter of 5.4 μm is manufactured in the same manner as Toner 1 except that Crystalline Polyurethane 3 is used instead of Crystalline Polyurethane 1.

Manufacturing of Development Agent 3

Development Agent 3 is manufactured in the same manner as Development Agent 1 except that Toner 3 is used instead of Toner 1.

EXAMPLE 4

Manufacturing of Toner 4

Toner 4 having a volume average particle diameter of 5.1 μm is manufactured in the same manner as Toner 1 except that Crystalline Polyurethane 4 is used instead of Crystalline Polyurethane 1.

Manufacturing of Development Agent 4

Development Agent 4 is manufactured in the same manner as Development Agent 1 except that Toner 4 is used instead of Toner 1.

EXAMPLE 5

Manufacturing of Toner 5

Toner 5 having a volume average particle diameter of 5.2 μm is manufactured in the same manner as Toner 1 except that Crystalline Polyurethane 5 is used instead of Crystalline Polyurethane 1.

Manufacturing of Development Agent 5

Development Agent 5 is manufactured in the same manner as Toner 1 except that Toner 5 is used instead of Toner 1.

EXAMPLE 6

Manufacturing of Toner 6

Toner 6 having a volume average particle diameter of 5.1 μm is manufactured in the same manner as Toner 1 except that Crystalline Polyurethane 6 is used instead of Crystalline Polyurethane 1.

Manufacturing of Development Agent 6

Development Agent 6 is manufactured in the same manner as Development Agent 1 except that Toner 6 is used instead of Toner 1.

EXAMPLE 7

Manufacturing of Toner 7

Toner 7 having a volume average particle diameter of 5.4 μm is manufactured in the same manner as Toner 1 except that Crystalline Polyurethane 7 is used instead of Crystalline Polyurethane 1.

Manufacturing of Development Agent 7

Development Agent 7 is manufactured in the same manner as Development Agent 1 except that Toner 7 is used instead of Toner 1.

EXAMPLE 8

Manufacturing of Toner 8

Toner 8 having a volume average particle diameter of 5.2 μm is manufactured in the same manner as Toner 1 except that Crystalline Polyurethane 8 is used instead of Crystalline Polyurethane 1.

Manufacturing of Development Agent 8

Development Agent 8 is manufactured in the same manner as Development Agent 1 except that Toner 8 is used instead of Toner 1.

EXAMPLE 9

Manufacturing of Toner 9

Mix 100 parts of Crystalline Polyurethane, 4,100 parts of cyan pigment (C.I. Pigment Blue 15: 3), and 30 parts of deionized water followed by mixing and kneading by an open roll type kneader (KNEADEX, manufactured by NIPPON COKE & ENGINEERING. CO., LTD.) to obtain a master batch of pigment.

To be specific, start mixing and kneading the mixture at 90° C. and cool it down gradually to 50° C.

Mix 100 parts of Crystalline Polyurethane 4, 100 parts of montmorillonite (CLAYTON APA, manufactured by SOUTHERN CLAY PRODUCTS INCORPORATE) in which quaternary ammonium ions having a benzyl group are substituted for cations present between layers, and 30 parts of deionized water followed by mixing and kneading by an open roll type kneader (KNEADEX, manufactured by NIPPON COKE & ENGINEERING. CO., LTD.) to obtain a master batch of a laminate inorganic compound. To be specific, start mixing and kneading the mixture at 90° C. and cool it down gradually to 50° C.

Place 20 parts of paraffin wax (HNP-9, melting point: 75° C., manufactured by NIPPON SEIRO CO., LTD.) and 80 parts of ethyl acetate in a reaction container equipped with a condenser, a thermometer, and a stirrer, heat the system to 78° C. to melt the wax; and cool it down to 30° C. in one hour while stirring.

Thereafter, wet-pulverize the resultant under the conditions of: liquid transfer speed 1.0 kg/h; disk circumferential speed: 10 m/s; filling ratio of 0.5 mm zirconia beads:80% by volume; number of passes: 6. by using ULTRAVISCOMILL from AIMEX. Adjust the solid portion concentration by adding ethyl acetate to obtain a liquid dispersion of wax having a solid portion concentration of 20% by weight.

Place 44 parts of Crystalline Polyurethane 4, 50 parts of Crystalline Polyurethane 9, and 91 parts of ethyl acetate in a container equipped with a thermometer and a stirrer and raise the temperature to the maximum endothermic peak temperatures of Crystalline Polyurethane 4 and Crystalline Polyurethane 9 in the second temperature rising or higher to dissolve it.

Next, add 25 parts of the liquid dispersion of wax, 2 parts of the master batch of the laminate inorganic compound, and 10 parts of the master batch of the pigment and thereafter conduct stirring at 10,000 rpm by a TK type HOMOMIXER (manufactured by TOKUSHU KIKA KOGYO CO., LTD.) at 50° C. to obtain a wax phase.

Toner 9 having a volume average particle diameter of 5.1 μm is manufactured in the same manner as Toner 1 except that the thus-obtained oil phase is used.

Manufacturing of Development Agent 9

Development Agent 9 is manufactured in the same manner as Toner 1 except that Toner 9 is used instead of Toner 1.

EXAMPLE 10

Manufacturing of Toner 10

Mix 100 parts of Crystalline Polyurethane 4, 100 parts of cyan pigment (C.I. Pigment Blue 15: 3), and 30 parts of deionized water followed by mixing and kneading by an open roll type kneader (KNEADEX, manufactured by NIPPON COKE & ENGINEERING. CO., LTD.) to obtain a master batch of pigment.

To be specific, start mixing and kneading the mixture at 90° C. and cool it down gradually to 50° C.

Mix 100 parts of Crystalline Polyurethane 4, 100 parts of montmorillonite (CLAYTON APA, manufactured by SOUTHERN CLAY PRODUCTS INCORPORATE) in which quaternary ammonium ions having a benzyl group are substituted for cations present between layers, and 30 parts of deionized water followed by mixing and kneading by an open roll type kneader (KNEADEX, manufactured by NIPPON COKE & ENGINEERING. CO., LTD.) to obtain a master batch of a laminate inorganic compound.

To be specific, start mixing and kneading the mixture at 90° C. and cool it down gradually to 50° C.

Place 20 parts of paraffin wax (HNP-9, melting point: 75° C., manufactured by NIPPON SEIRO CO., LTD.) and 80 parts of ethyl acetate in a reaction container equipped with a condenser, a thermometer, and a stirrer, heat the system to 78° C. to melt the wax; and cool it down to 30° C. in one hour while stirring. Thereafter, wet-pulverize the resultant under the conditions of: liquid transfer speed 1.0 kg/h; disk circumferential speed: 10 m/s; filling ratio of 0.5 mm zirconia beads: 80% by volume; number of passes: 6. by using ULTRAVISCOMILL from AIMEX.

Adjust the solid portion concentration by adding ethyl acetate to obtain a liquid dispersion of wax having a solid portion concentration of 20% by weight.

Place 44 parts of Crystalline Polyurethane 4 and 41 parts of ethyl acetate in a container equipped with a thermometer and a stirrer and raise the temperature to the maximum endothermic peak temperature in the second temperature rising of Crystalline Polyurethane 4 or higher to dissolve it. Next, add 25 parts of the liquid dispersion of wax, 2 parts of the master batch of the laminate inorganic compound, and 10 parts of the master batch of the pigment and thereafter conduct stirring at 10,000 rpm by a TK type HOMOMIXER (manufactured by TOKUSHU KIKA KOGYO CO., LTD.) at 50° C.

Add 100 parts of 50% by weight of ethyl acetate solution of Polyurethane Prepolymer 1 and 1.3 parts of 20% by weight of ethyl acetate solution of isophorone diamine and thereafter conduct stirring at 12,000 rpm by a TK type HOMOMIXER (manufactured by TOKUSHU KIKA KOGYO CO., LTD.) at 50° C. to obtain a wax phase.

Place 90 parts of deionized water, 3 parts of 25% by weight liquid dispersion of copolymer particulates of styrene, methacrylic acid-butyl acrylate-sodium salt of an adduct of sulfuric ester with ethylene oxide methacrylate (manufactured by SANYO CHEMICALS INDUSTRIES, LTD.), 1 part of carboxy methyl cellulose sodium, 16 parts of 48.5% aqueous solution of dodecyl diphenyl ether sodium disulfonate (EREMINOR MON-7, manufactured by SANYO CHEMICALS INDUSTRIES, LTD.), and 5 parts of ethylacetate in a container equipped with a stirrer and a thermometer and thereafter stir them at 40° C. to prepare an aqueous phase.

Add 80 parts of the oil phase maintained at 50° C. to the oil phase followed by stirring for one minute at 40° C. to 50° C. by a TK type HOMOMIXER (manufactured by PRIMIX CORPORATION) at 116,000 rpm to obtain an emulsified slurry.

Place the emulsified slurry in a reaction container equipped with a stirrer and a thermometer followed by removal of the solvent at 60° C. for 2 hours.

Subsequent to a 10 hour aging at 45° C., a dispersion slurry is prepared.

Toner 10 having a volume average particle diameter of 5.2 μm is manufactured in the same manner as Toner 1 except that the thus-obtained emulsified slurry is used.

Manufacturing of Development Agent 10

Development Agent 10 is manufactured in the same manner as Toner 1 except that Toner 10 is used instead of Toner 1.

EXAMPLE 11

Mix 100 parts of Crystalline Polyurethane 4, 100 parts of cyan pigment (C.I. Pigment Blue 15: 3), and 30 parts of deionized water followed by mixing and kneading by an open roll type kneader (KNEADEX, manufactured by NIPPON COKE & ENGINEERING. CO., LTD.) to obtain a master batch of pigment.

To be specific, start mixing and kneading the mixture at 90° C. and cool it down gradually to 50° C.

Mix 100 parts of Crystalline Polyurethane 4, 100 parts of montmorillonite (CLAYTON APA, manufactured by SOUTHERN CLAY PRODUCTS INCORPORATE) in which quaternary ammonium ions having a benzyl group are substituted for cations present between layers, and 30 parts of deionized water followed by mixing and kneading by an open roll type kneader (KNEADEX, manufactured by NIPPON COKE & ENGINEERING. CO., LTD.) to obtain a master batch of a laminate inorganic compound.

To be specific, start mixing and kneading the mixture at 90° C. and cool it down gradually to 50° C.

Place 20 parts of paraffin wax (HNP-9, melting point: 75° C., manufactured by NIPPON SEIRO CO., LTD.) and 80 parts of ethyl acetate in a reaction container equipped with a condenser, a thermometer, and a stirrer, heat the system to 78° C. to melt the wax; and cool it down to 30° C. in one hour while stirring.

Thereafter, wet-pulverize the resultant under the conditions of: liquid transfer speed 1.0 kg/h; disk circumferential speed: 10 m/s; filling ratio of 0.5 mm zirconia beads:80% by volume; number of passes: 6 by using ULTRAVISCOMILL from AIMEX.

Adjust the solid portion concentration by adding ethyl acetate to obtain a liquid dispersion of wax having a solid portion concentration of 20% by weight.

Place 44 parts of Crystalline Polyurethane 4, 50 parts of Crystalline Polyester 1, and 91 parts of ethyl acetate in a container equipped with a thermometer and a stirrer and raise the temperature to the maximum endothermic peak temperatures of Crystalline Polyurethane 4 and Crystalline Polyester 1 in the second temperature rising or higher to dissolve it. Next, add 25 parts of the liquid dispersion of wax, 2 parts of the master batch of the laminate inorganic compound, and 10 parts of the master batch of the pigment and thereafter conduct stirring at 10,000 rpm by a TK type HOMOMIXER (manufactured by TOKUSHU KIKA KOGYO CO., LTD.) at 50° C. to obtain a wax phase.

Toner 11 having a volume average particle diameter of 5.2 μm is manufactured in the same manner as Toner 1 except that the thus-obtained oil phase is used.

Manufacturing of Development Agent 11

Development Agent 11 is manufactured in the same manner as Toner 1 except that Toner 11 is used instead of Toner 1.

EXAMPLE 12

Mix 100 parts of Crystalline Polyurethane 4, 100 parts of cyan pigment (C.I. Pigment Blue 15: 3), and 30 parts of deionized water followed by mixing and kneading by an open roll type kneader (KNEADEX, manufactured by NIPPON COKE & ENGINEERING. CO., LTD.) to obtain a master batch of pigment.

To be specific, start mixing and kneading the mixture at 90° C. and cool it down gradually to 50° C.

Mix 100 parts of Crystalline Polyurethane 4, 100 parts of montmorillonite (CLAYTON APA, manufactured by SOUTHERN CLAY PRODUCTS INCORPORATE) in which quaternary ammonium ions having a benzyl group are substituted for cations present between layers, and 30 parts of deionized water followed by mixing and kneading by an open roll type kneader (KNEADEX, manufactured by NIPPON COKE & ENGINEERING. CO., LTD.) to obtain a master batch of a laminate inorganic compound.

To be specific, start mixing and kneading the mixture at 90° C. and cool it down gradually to 50° C.

Place 20 parts of paraffin wax (HNP-9, melting point: 75° C., manufactured by NIPPON SEIRO CO., LTD.) and 80 parts of ethyl acetate in a reaction container equipped with a condenser, a thermometer, and a stirrer, heat the system to 78° C. to melt the wax; and cool it down to 30° C. in one hour while stirring.

Thereafter, wet-pulverize the resultant under the conditions of: liquid transfer speed 1.0 kg/h; disk circumferential speed: 10 m/s; filling ratio of 0.5 mm zirconia beads:80% by volume; number of passes: 6 by using ULTRAVISCOMILL from AIMEX.

Adjust the solid portion concentration by adding ethyl acetate to obtain a liquid dispersion of wax having a solid portion concentration of 20% by weight.

Place 44 parts of Crystalline Polyurethane 4, 50 parts of Non-Crystalline Polyester 1, and 91 parts of ethyl acetate in a container equipped with a thermometer and a stirrer and raise the temperature to the maximum endothermic peak temperature of Crystalline Polyurethane 4 and Non-Crystalline Polyester 1 in the second temperature rising or higher to dissolve it.

Next, add 25 parts of the liquid dispersion of wax, 2 parts of the master batch of the laminate inorganic compound, and 10 parts of the master batch of the pigment and thereafter conduct stirring at 10,000 rpm by a TK type HOMOMIXER (manufactured by TOKUSHU KIKA KOGYO CO., LTD.) at 50° C. to obtain a wax phase.

Toner 12 having a volume average particle diameter of 5.0 μm is manufactured in the same manner as Toner 1 except that the thus-obtained oil phase is used.

Manufacturing of Development Agent 12

Development Agent 12 is manufactured in the same manner as Toner 1 except that Toner 12 is used instead of Toner 1.

EXAMPLE 13

Manufacturing of Carrier 2

Carrier 2 is manufactured in the same manner as Carrier 1 except that N-hexa methoxy methyl melamine resin having a polymerization degree of 1.7 is used instead of N-tetra methoxy methyl benzoguanamine resin having a polymerization degree of 1.5.

Manufacturing of Development Agent 13

Development Agent 13 is manufactured in the same manner as Development Agent 1 except that Carrier 2 is used instead of Carrier 1.

EXAMPLE 14

Manufacturing of Carrier 3

Carrier 3 is manufactured in the same manner as Carrier 1 except for not using alumina particles having an average primary particle diameter of 0.30 μm.

Manufacturing of Development Agent 14

Development Agent 14 is manufactured in the same manner as Development Agent 1 except that Carrier 3 is used instead of Carrier 1.

COMPARATIVE EXAMPLE 1

Manufacturing of Carrier 4

Stir 450 parts of toluene, 450 parts of silicone resin having an involatile portion of 50% by weight (SR2400, manufactured by DOW CORNING TORAY CO., LTD.), 10 parts of amino silane (SH6020, manufactured by DOW CORNING TORAY CO., LTD.), and 15 parts of alumina particles having an average primary particle diameter of 0.30 μm with a stirrer for 10 minutes to obtain a liquid application of coating layer.

Place 5,000 parts of Mn-ferrite particles having a volume average particle diameter (D50) of 35 μm in an applicator having a rotatable base disk and a stirring wing in the fluidizing bed to form a swirl flow, apply the liquid application of coating layer to the particles, and bake them at 250° C. for 2 hours using an electric furnace to obtain Carrier 4.

Manufacturing of Development Agent 15

Development Agent 15 is manufactured in the same manner as Development Agent 4 except that Carrier 4 is used instead of Carrier 1.

COMPARATIVE EXAMPLE 2

Manufacturing of Development Agent 16

Development Agent 16 is manufactured in the same manner as Development Agent 8 except that Carrier 4 is used instead of Carrier 1.

COMPARATIVE EXAMPLE 3

Manufacturing of Development Agent 17

Development Agent 17 is manufactured in the same manner as Development Agent 9 except that Carrier 4 is used instead of Carrier 1.

COMPARATIVE EXAMPLE 4

Manufacturing of Development Agent 18

Development Agent 18 is manufactured in the same manner as Development Agent 10 except that Carrier 4 is used instead of Carrier 1.

Volume Average Particle Diameter

The volume average particle diameter of the toner can be measured by COULTER COUNTER MULTISIZER II (manufactured by BECKMAN COULTER INC.).

The aperture is 100 μm and BECKMAN COULTER MULTISIZER 3 VERSION 3.51 (manufactured by BECKMAN COULTER INC.) is used as analysis software.

To be specific, add 10 mg of toner to 5 ml of 10% by weight surface active agent (alkyl benzene sulfonate) (NEOGENE SC-A, manufactured by Dai-Ichi Kogyo Seiyaku Co., Ltd.) followed by dispersion for one minute using an ultrasonic dispersion device and add 25 ml of ISOTONE III (manufactured by BECKMAN COULTER CO., LTD. followed by dispersion for one minute using an ultrasonic dispersion device.

Thereafter, place the liquid dispersion with 100 ml of an electrolysis solution in a beaker, measure the particles of 30,000 particles in such a concentration that the particles of 30,000 particles can be measured in 20 seconds to obtain the volume average particle diameter from the particle size distribution.

Amount of Melting Heat ΔH(T) in Second Temperature Rising

The amount of melting heat ΔH (T) in the second temperature rising is obtained in the same manner as the maximum endothermic peak temperature Td in the second temperature rising and the maximum exothermic peak temperature Td' in the first temperature descending.

Amount of Melting Heat ΔH(H) of Component Insoluble in Solvent Mixture in Second Temperature Rising Reflux 1 g of the toner in 100 ml of a liquid mixture of tetrahydrofuran and ethyl acetate with a mass ratio of 1:1 followed by cooling-down.

Filtrate the liquid with a filter having an opening diameter of 0.2 μm and wash the filtrate followed by drying.

The amount of melting heat ΔH(H) of the component soluble in the liquid mixture in the second temperature rising is obtained in the same manner as the amount of melting heat ΔH (T) in the second temperature rising except for using the obtained sample.

Content C of Component Having Molecular Weight of 100,000 or more Soluble in Tetrahydrofuran and Weight Average Molecular Weight Mw Reflux 1 g of the toner in 100 ml of tetrahydrofuran followed by cooling-down. Filtrate the liquid with a filter having an opening diameter of 0.2 μm followed by removal of the solvent.

The content and the weight average molecular weight of the component having a molecular weight of 100,000 or more soluble in tetrahydrofuran are obtained in the same manner except for using the obtained sample.

Crystallinity

Using a two-dimension detector installed X-ray diffraction device (D8 DISCOVER with GADDS, manufactured by BRUKER JAPAN CO., LTD.), measure X-ray diffraction spectrum of the toner.

The capillary used for in the X-ray diffraction measuring is a mark tube (Lindemann glass) having a diameter of 0.70 mm with the toner filled up to the upper portion of the capillary tube. The number of tapping when filling the toner is 100.

The detailed measuring conditions are as follows:

Current: 40 mA

Voltage: 40 kV

Goniometer 2θ axis: 20.0000°

Goniometer Ω axis: 0.0000°

Goniometer ϕ axis: 0.0000°

Detector distance: 15 cm (wide angle measuring)

Measuring range: 3.2≤2θ (°)≤37.2

Measuring time: 600 sec.

A collimator having pinhole having a diameter of 1 mm is used in the light incident optical system.

The obtained two-dimensional data are integrated (χ axis: 3.2° to 37.2°) and converted by an attached software to a single-dimensional data of the diffraction intensity and 2θ.

Table 2 shows the properties of the toner.

TABLE 2

| Toner | Crystalline poly-urethane | Td (° C.) | Tf (° C.) | Tf/Td | Td' (° C.) | Td-Td' (° C.) |
|---|---|---|---|---|---|---|
| 1 | 1 | 69 | 76 | 1.10 | 46 | 23 |
| 2 | 2 | 65 | 69 | 1.06 | 43 | 22 |
| 3 | 3 | 63 | 82 | 1.30 | 40 | 23 |
| 4 | 4 | 61 | 81 | 1.33 | 41 | 20 |
| 5 | 5 | 56 | 82 | 1.46 | 36 | 20 |
| 6 | 6 | 55 | 85 | 1.55 | 30 | 25 |
| 7 | 7 | 66 | 105 | 1.59 | 37 | 29 |
| 8 | 8 | 61 | 88 | 1.44 | 32 | 29 |
| 9 | 4 9 | 63 | 79 | 1.25 | 35 | 28 |
| 10 | 4*1 | 63 | 88 | 1.40 | 39 | 24 |
| 11 | 4*2 | 61 | 74 | 1.21 | 44 | 17 |
| 12 | 4*3 | 59 | 93 | 1.58 | 28 | 31 |

TABLE 2-continued

| Toner | ΔH(T) (J/g) | ΔH(H)/ ΔH(T)(J/g) | Crystal-linity (%) | C (%) | Mw |
|---|---|---|---|---|---|
| 1 | 87 | — | 45 | 2.1 | 24,000 |
| 2 | 84 | — | 44 | 0.8 | 25,500 |
| 3 | 65 | — | 34 | 3.2 | 24,200 |
| 4 | 75 | — | 37 | 5.2 | 25,400 |
| 5 | 66 | — | 18 | 5.0 | 20,700 |
| 6 | 58 | — | 15 | 0.4 | 20,200 |
| 7 | 45 | 0.79 | 36 | 8.9 | 17,000 |
| 8 | 61 | — | 29 | 6.0 | 25,400 |
| 9 | 60 | 0.85 | 33 | 14.3 | 54,500 |
| 10 | 56 | 1.07 | 31 | 13.7 | 52,700 |
| 11 | 77 | — | 40 | 2.4 | 22,400 |
| 12 | 42 | — | 15 | 2.2 | 24,300 |

*1Used in combination with urea-modified crystalline polyurethane

*2Used in combination with cryatalline polyester

*3Used in combination with non-cryatalline polyester

No component insoluble in the liquid mixture is obtained in Toner 1 to 6, 8, 11, and 12.

Fill with the thus-manufactured development agent the development unit in a tandem type image forming apparatus (imagio MP C5001, manufactured by RICOH CO., LTD.) employing systems of contact charging, two component development, indirect two-step transfer, blade cleaning, and external heating roller fixing and form images followed by the performance evaluation on the low-temperature fixability of the toner, the decrease of the size of charge of the carrier, and the damage to the image during transfer thereof in the paper path. The high-temperature stability of the toner is also evaluated.

Low-Temperature Fixability of Toner

Form a solid image having an area of 3 cm×8 cm on photocopying printing paper (<70>, manufactured by RICOH BUSINESS EXPERT CO., LTD.) with an attached amount of toner of from 0.75 mg/cm$^2$ to 0.95 mg/cm$^2$ and fix the image while changing the temperature of the fixing belt.

The solid image is formed at a position 3.0 cm from the front end of the photocopying printing paper of the paper passing direction.

The passing speed of the photocopying printing paper at the nipping portion of the fixing device is 280 mm/s.

Using a drawing tester (AD-401, manufactured by UESHIMA SEISAKUSHO CO., LTD.), draw on the surface of the fixed solid image with a ruby needle having a tip diameter of from 260 μm to 320 μm and a point angle of 60° under a load of 50 g and rub the image surface by a fiber (HONECOTTO #440, manufactured by SAKATA INX ENG. CO., LTD.) five times.

The temperature of the fixing belt at which almost no image scraping occurs is determined as the lowest fixing temperature.

The lowest fixing temperature is evaluated as follows:

E (Excellent): lower than 100° C.

G (Good): 100° C. to lower than 110° C.

F (Fair): 110° C. to lower than 120° C.

B (Bad): 120° C. to lower than 140° C.

VB (Very bad): 140° C. or higher

High-Temperature Stability of Toner

Fill a glass container with the toner and leave it in a constant bath at 50° C. for 24 hours followed by cooling-down to 24° C.

Measure the penetration degree by a penetration test (JIS K2235-1991).

The penetration degree is evaluated as follows:

E (Excellent): 25 mm or greater

G (Good): 20 mm to less than 25 mm

F (Fair): 15 mm to less than 20 mm

B (Bad): 10 mm to less than 15 mm

VB (Very bad): less than 10 mm.

Decrease of Sixe of Charge

Print an image chart having an image area of 5% in a single color mode on five sheets of A4 paper (MY RECYCLE PAPER, manufactured by NBS RICOH CO., LTD.) in landscape per job.

Repeat the job until the number of output reaches 50,000 sheets.

Place 2.0 g of the development agent before and after 50,000 output in a blow-off gauge having a metal mesh of 635 meshes at both ends, air-blow the development agent with an blowing air pressure of 2.5 kPa for one minute, and measure the size of charge of the carrier remaining in the gauge.

When the size of charge of the carrier measured by using the development agent before outputting 50,000 sheets is Qi (μC/g) and the size of charge of the carrier measured by using the development agent after outputting 50,000 sheets is Qe (μC/g), the decrease of the size of charge of the carrier is calculated by the relation: Qe−Qi.

The size of charge is evaluated as follows:

E (Excellent): less than 4 μC/g

G (Good): 4 μC/g to less than 8 μC/g

F (Fair): 8 μC/g to less than 12 μC/g

B (Bad): 12 μC/g to less than 18 μC/g

VB (Very bad): 18 μC/g or greater.

Damage to Image During Transfer

Form a solid image with an attachment amount of toner of from 0.75 mg/cm$^2$ to 0.95 mg/cm$^2$ on the entire of transfer type paper (6200, manufactured by RICOH CO., LTD.) and make evaluation of the degree of the damage to the solid image caused by the discharging roller in comparison with the reference.

Set the temperature of the fixing belt 10° C. higher than the lowest fixing temperature of the toner and set the passing speed of the paper at the nipping portion of the fixing device to be 280 mm/s.

Print continuously an image on 20 A4 size sheets in landscape in total while one job includes five sheet printing.

The evaluation results are the average of the output 20 solid images.

The damage during transfer is evaluated as follows:

E (Excellent): No damage observed

G (Good): Damage very slightly observed depending on the observation angle without causing a practical problem F (Fair): Damage slightly observed without causing a practical problem B (Bad): Damage clearly observed with a practical problem Table 3 shows the evaluation results of the low-temperature fixability and the high-temperature stability of the toner, the decrease of the size of charge of the carrier, and the damage to the image during transfer.

TABLE 3

| | Toner | | | Carrier | | Damage |
|---|---|---|---|---|---|---|
| | Kind | Low-temperature fixability | High-temperature stability | Kind | Decrease of size of charge | to image during transfer |
| Example 1 | 1 | E | E | 1 | G | G |
| Example 2 | 2 | E | E | 1 | G | G |
| Example 3 | 3 | E | G | 1 | G | G |
| Example 4 | 4 | E | G | 1 | G | E |

TABLE 3-continued

| | Toner | | | Carrier | | Damage |
|---|---|---|---|---|---|---|
| | Kind | Low-temperature fixability | High-temperature stability | Kind | Decrease of size of charge | to image during transfer |
| Example 5 | 5 | E | G | 1 | G | E |
| Example 6 | 6 | E | F | 1 | G | G |
| Example 7 | 7 | F | G | 1 | E | E |
| Example 8 | 8 | E | G | 1 | E | E |
| Example 9 | 9 | E | G | 1 | G | E |
| Example 10 | 10 | E | E | 1 | E | E |
| Example 11 | 11 | E | G | 1 | G | E |
| Example 12 | 12 | F | F | 1 | G | F |
| Example 13 | 10 | E | E | 2 | E | G |
| Example 14 | 10 | E | E | 3 | G | G |
| Comparative Example 1 | 4 | E | G | 4 | VB | E |
| Comparative Example 2 | 8 | E | G | 4 | VB | E |
| Comparative Example 3 | 9 | E | G | 4 | B | G |
| Comparative Example 4 | 10 | E | E | 4 | B | G |

As seen in Table 3, the development agents of Examples 1 to 15 are excellent about the low-temperature fixability and the high-temperature stability of the toner and prevent the decrease of the size of charge of the carrier.

To the contrary, the coating layer of the carrier of the development agent of Comparative Examples 1 to 4 contains no condensed compound of a melamine resin and/or a guanamine resin and an acrylic resin having a hydroxyl group, so that the size of charge of the carrier decreases.

What is claimed is:

1. A development agent comprising:

toner comprising:

a binder resin comprising crystalline resin that has a urethane and/or urea bond in a main chain thereof;

a coloring agent; and an organically modified inorganic laminate compound in which organic ions are at least partially substituted for ions present between layers of the organically modified inorganic laminate compound; and toner carrier comprising a core material whose surface is coated with a coating layer comprising a condensed compound of a melamine resin and/or a guanamine resin and an acrylic resin having a hydroxyl group.

2. The development agent according to claim 1, wherein the toner has a crystallinity of 15% or more.

3. The development agent according to claim 1, wherein the toner has a maximum endothermic peak temperature of from 45° C. to 75° C. for a second temperature rising as measured by differential scanning calorimetery and an amount of melting heat for the second temperature rising is from 30 J/g to 75 J/g.

4. The development agent according to claim 1, wherein the toner satisfies the relations: Td−Td'≤30° C. and Td'≥30° C., where Td represents a maximum endothermic peak temperature (° C.) or a second time temperature rising and Td' represents a maximum exothermic peak temperature (° C.) for a second temperature descending as measured by differential scanning calorimetry.

5. The development agent according to claim 1, wherein a tetrahydrofuran-soluble component in the toner has a weight average molecular weight of from 20,000 to 70,000, with a molecular weight of 100,000 or greater accounting for 5% or more in the tetrahydrofuran-soluble component.

6. The development agent according to claim 1, wherein the toner has a ratio of an amount of melting heat of a component of the toner insoluble in a solvent mixture of tetrahydrofuran and ethyl acetate with a mass ratio of 1:1 for a second temperature rising as measured by of differential scanning calorimetery to an amount of melting heat of the toner for a second temperature rising of from 0.2 to 1.25.

7. The development agent according to claim 1, wherein the crystalline resin is 50% by weight or more of the binder resin.

8. The development agent according to claim 1, wherein the crystalline resin is polyurethane having a composition unit deriving from a polyester diol.

9. The development agent according to claim 8, wherein the polyurethane is a block copolymer having a polyester block and a polyurethane block.

10. The development agent according to claim 9, wherein the polyurethane contains the polyester block in an amount of from 50% by weight to 98% by weight.

11. The development agent according to claim 1, wherein the crystalline resin comprises a first crystalline resin and a second crystalline resin having a weight average molecular weight greater than the first crystalline resin.

12. The development agent according to claim 1, wherein the binder resin comprises urea-modified crystalline polyurethane.

13. The development agent according to claim 1, wherein the organically modified inorganic laminate compound is montmorillonite in which quaternary ammonium ions having a benzyl group are at least partially substituted for cations present between layers of the organically modified inorganic laminate compound.

14. The development agent according to claim 1, wherein the guanamine resin is N-alkoxy alkylized benzoguanamine resin.

15. The development agent according to claim 1, wherein the coating layer further comprises inorganic oxide particles.

16. An image forming apparatus comprising:

an image bearing member to bear a latent electrostatic image thereon;

a charger to charge the image bearing member;

an irradiator to irradiate a charged image bearing member to form the latent electrostatic image thereon;

a development device to develop the latent electrostatic image with the development agent of claim 1 to obtain a toner image;

a transfer device to transfer the toner image formed on the image bearing member onto a recording medium; and a fixing device to fix the toner image transferred onto the recording medium.

* * * * *